US006386666B1

(12) United States Patent
Takamura et al.

(10) Patent No.: US 6,386,666 B1
(45) Date of Patent: May 14, 2002

(54) INK-JET HEAD DRIVING DEVICE

(75) Inventors: Jun Takamura, Mishima; Noboru Nitta; Shunichi Ono, both of Shizuoka-ken, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/248,646

(22) Filed: Feb. 11, 1999

(30) Foreign Application Priority Data

Feb. 13, 1998 (JP) ..... 10-031277

(51) Int. Cl.[7] ..... B41J 29/38
(52) U.S. Cl. ..... 347/12; 347/9
(58) Field of Search ..... 347/9, 12

(56) References Cited

U.S. PATENT DOCUMENTS

| | | | | |
|---|---|---|---|---|
| 4,251,823 A | | 2/1981 | Sagae | 347/12 |
| 5,142,296 A | | 8/1992 | Lopez et al. | 347/12 |
| 5,266,965 A | | 11/1993 | Komai et al. | 347/12 |
| 6,168,251 B1 | * | 1/2001 | Imanaki et al. | 347/9 |
| 6,286,925 B1 | * | 9/2001 | Heinzl et al. | 347/12 |

FOREIGN PATENT DOCUMENTS

| | | | |
|---|---|---|---|
| EP | 0 535 705 A | 4/1993 | B41J/2/355 |
| EP | 0 552 719 A | 7/1993 | B41J/2/355 |
| EP | 0 692 383 A | 1/1996 | B41J/2/04 |
| EP | 0 778 132 A | 6/1997 | B41J/2/045 |
| EP | 0 779 151 A | 6/1997 | B41J/2/045 |
| JP | 59-33117 | 8/1984 | B41J/3/04 |
| JP | 60-8075 | 1/1985 | B41J/3/04 |
| JP | 62-116154 | 5/1987 | B41J/3/04 |
| JP | 63-312842 | 12/1988 | B41J/3/04 |
| JP | 02-164545 | 6/1990 | B41J/2/05 |
| JP | 9-109389 | 4/1997 | B41J/2/045 |

OTHER PUBLICATIONS

Texas Instrumentrs Data Sheet, SCHS025, p. 3–42, 1998.*

* cited by examiner

*Primary Examiner*—John Barlow
*Assistant Examiner*—Alfred E. Dudding
(74) *Attorney, Agent, or Firm*—Frishauf, Holtz, Goodman, Langer & Chick, P.C.

(57) ABSTRACT

In an ink-jet head driving device, data of a shift register is latched by a latch circuit. The data latched by the latch circuit is input to energization signal selection circuits. At this time, each selection circuit receives 1-bit data for operating a corresponding ink chamber, and 2-bit data for operating adjacent ink chambers as reference data. Each selection circuit selects one from energization signals using the 3-bit data, and supplies the selected energization signal to a corresponding head driver, thereby generating a drive waveform for driving the ink chamber.

13 Claims, 16 Drawing Sheets

INK-JET HEAD DRIVING DEVICE

BACKGROUND OF THE INVENTION

The present invention relates to an ink-jet head driving device for simultaneously driving a line of ink chambers to pint dots with ink drops ejected therefrom.

A conventional ink-jet printer performs printing using a print head having a plurality of ink chambers separated from each other by partitions made of, e.g., electrostrictive members. This print head ejects ink from an ink-jet nozzle upon changes in pressure of each ink chamber caused by vibration of the partitions. This print head is difficult to avoid mutual interference of adjacent ink chambers when the partitions simultaneously vibrate for the ink chambers in order to print dots of the same tone-level. This mutual interference does not allow the pressure of each ink chamber to change in the same manner as when corresponding partitions vibrate. Resultant variations in the ejected amount of ink make the print quality unstable.

A solution of this problem is disclosed in, e.g., Jpn. Pat. Appln. KOKAI Publication No. 62-116154. In this publication, each driver for an ink chamber receives an energization signal supplied to itself and, as correction signals via resistors, energization signals supplied to drivers for adjacent ink chambers driven at the same time as the target ink chamber. The driver corrects the supplied energization signal on the basis of the energization signals supplied via the resistors. More specifically, the voltage level of the correction signals are set by the resistors to represent interference pressure generated in the adjacent ink chambers. The target ink chamber is driven by an energization signal of a voltage level decreased according the voltage levels of the correction signals in the driver.

According to the driving technique of this publication, however, each ink chamber is driven without considering any interference pressure from ink chambers other than adjacent ink chambers, and the correction amount of the energization signal is fixed by the resistance value of each resistor. Therefore, this technique is difficult to control the ink ejection amount of a line print head with high precision in multi-tone printing.

BRIEF SUMMARY OF THE INVENTION

It is an object of the present invention to provide an ink-jet head driving device capable of easily considering interference from ink chambers other than adjacent ink chambers.

According to the present invention, there is provided an ink-jet head driving device for an ink-jet head having a line of ink chambers, comprising a reception unit for receiving dot data corresponding to each ink chamber of the print head, a decoding unit for selectively decoding (j+k)-bit data made up of received j-bit dot data ($j \geqq 1$) of a target ink chamber and k-bit dot data ($k \geqq 1$) of neighboring ink chambers, an input unit for inputting a plurality of energization signals, and a selection unit for selecting one energization signal from the plurality of energization signals, wherein the selection unit is arranged to determine an energization signal to be selected based on a decoding result of the decoding and to drive the target ink chamber with a waveform obtained by the energization signal selected thereby.

In this ink-jet head driving device, decoding is performed on the basis of dot data for each target ink chamber and dot data for ink chambers neighboring to the target ink chamber. That is, ink chambers other than the ink chambers next to the target ink chamber can be easily considered to drive the target ink camber, and the ink ejection amount of each ink chamber can be controlled with high precision. This realizes stable print quality.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet head driving device according to the first embodiment of the present invention will be described with reference to the accompanying drawings.

Figure 1:
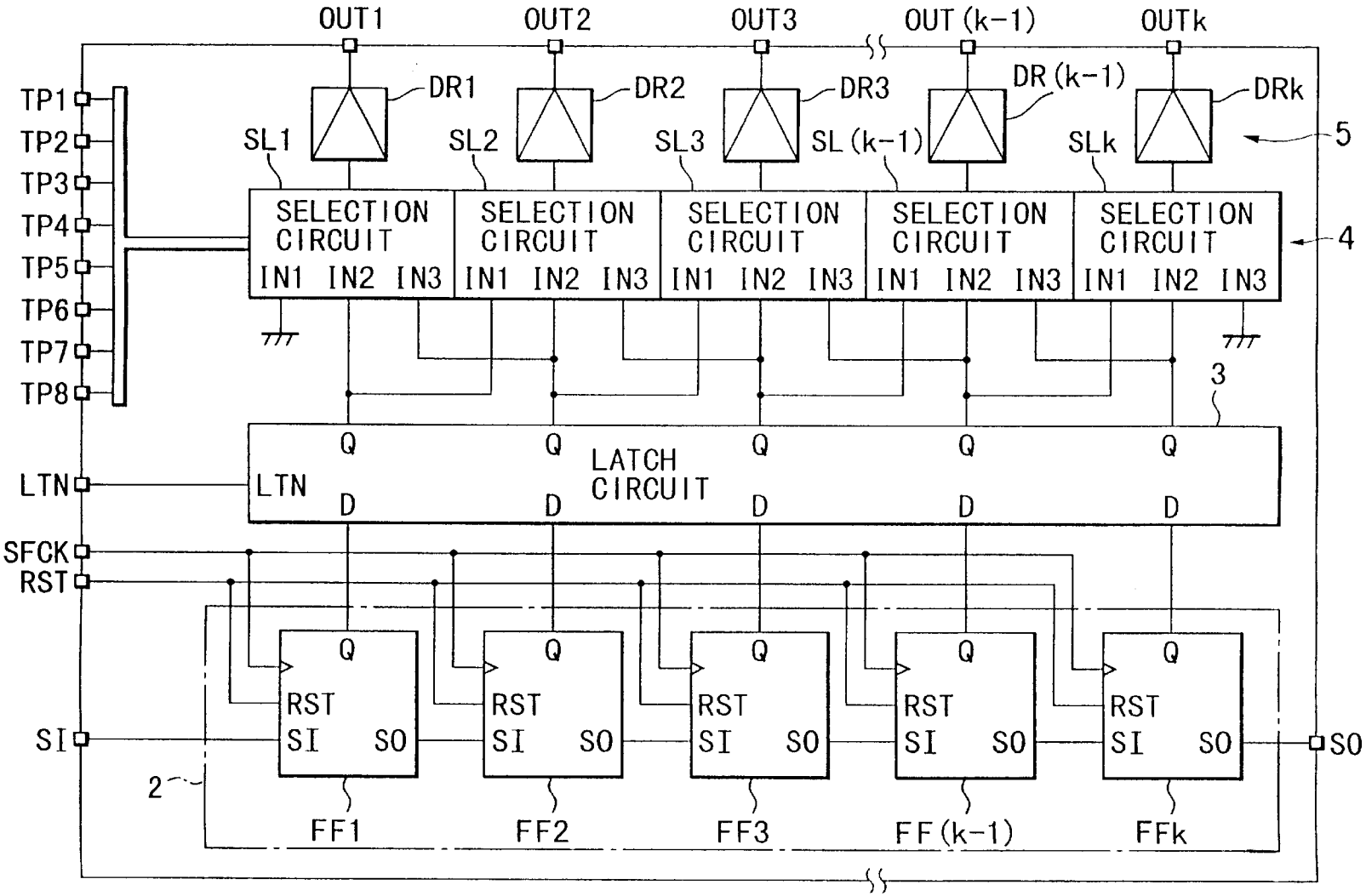
FIG. 1 is a block diagram showing the circuit of an ink-jet head driving device according to the first embodiment of the present invention.

As shown in FIG. 1, this ink-jet head driving device comprises as a reception unit a shift register 2 made up of k registers FF1, FF2, FF3, . . . , FF(k−1), and FFk for receiving 1-bit dot data SI supplied serially. The registers FF1 to FFk of the shift register 2 sequentially receive dot data for one line while shifting the dot data in synchronism with a shift clock SFCK. Each of the registers FF1 to FFk is reset by a reset signal RST.

The dot data for one line received by the registers FF1 to FFk of the shift register 2 are latched by a latch circuit 3 in response to a latch signal LTN.

Output pins OUT1 to OUTk are provided to obtain drive waveforms for driving k ink chambers aligned in a line print head. Selected energization signals are respectively output from k energization signal selection circuits SL1, SL2, SL3, . . . , SL(k−1), and SLk serving as decoding and energization signal selection units 4 to head drivers DR1, DR2, DR3, . . . , DR(k−1), and DRk serving as a driving unit 5, and drive waveforms are output from the head drivers DR1 to DRk to the output pins OUT1 to OUTk.

Each of the energization signal selection circuits SL1 to SLk has three input terminals IN1, IN2, and IN3. The input terminal IN2 receives 1-bit dot data corresponding to each ink chamber, the input terminal IN1 receives 1-bit dot data corresponding to a neighboring preceding ink chamber, and the input terminal IN3 receives 1-bit dot data corresponding to a neighboring subsequent ink chamber. The input terminal IN1 of the first energization waveform selection circuit SL1 and the input terminal IN3 of the final energization waveform selection circuit SLk are grounded.

Each of the energization waveform selection circuits SL1 to SLk selects one of energization signals TP1 to TP8 of eight tone-levels produced from an energization signal source (not shown), like the ones shown in Table 1, based on 3-bit dot data input via the input terminals IN1, IN2, and IN3. The energization waveform selection circuits SL1 to SLk respectively supply the selected energization signals to the head drivers DR1 to DRk, and the head drivers DR1 and DRk respectively output drive waveforms corresponding to the energization signals to the output pins OUT1 to OUTk. The energization signal TP1 is a ground-level signal.

TABLE 1

| Input Data IN1–IN3 of Energization Selection Circuit (Hex) | Energization Signal TPn |
|---|---|
| 7 | TP8 |
| 6 | TP7 |
| 5 | TP6 |
| 4 | TP5 |
| 3 | TP4 |
| 2 | TP3 |
| 1 | TP2 |
| 0 | TP1 |

More specifically, 1-bit dot data input via the input terminal IN2 is original dot data for selecting an energization signal for driving a corresponding ink chamber. Each of the energization signal selection circuits SL1 to SLk refers to dot data corresponding to neighboring ink chambers that are input via the input terminal IN1 and IN3, and changes an energization signal to be selected in accordance with the contents of the dot data.

Figure 2:
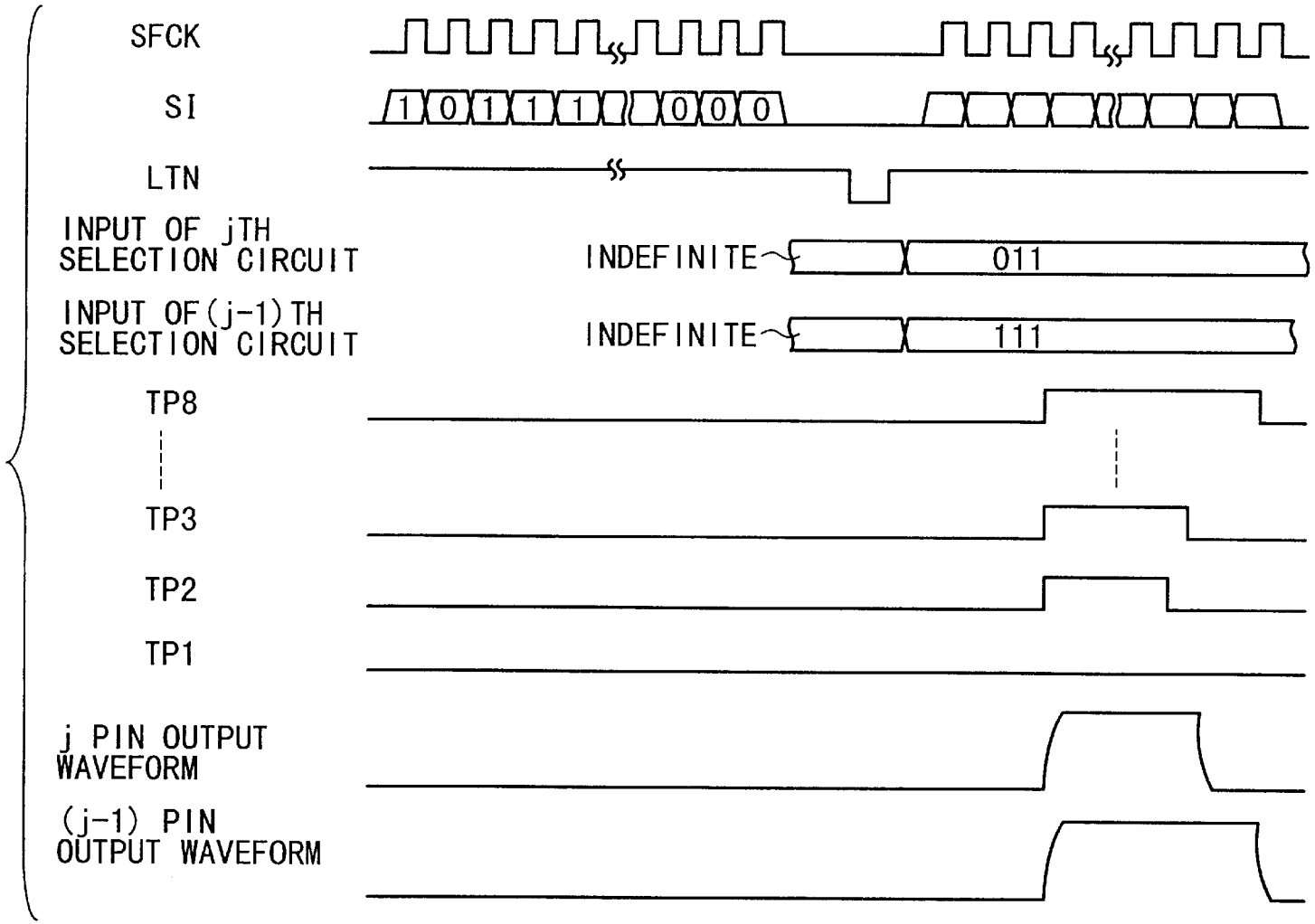
FIG. 2 is a timing chart showing an operation when 1-bit dot data is serially supplied to the ink-jet head driving device shown in FIG. 1.

In this arrangement, as shown in FIG. 2, dot data SI "10111, . . . 000" for one line are received by the registers FF1 to FFk of the shift register 2 in synchronism with the shift clock SFCK, and latched by the latch circuit 3 in response to the latch signal LTN. Then, "011" is input as 3-bit data input to the input terminals IN1, IN2, and IN3 of, e.g., the jth (j=1 to k) energization signal selection circuit, and "111" is input as 3-bit data to the input terminals IN1, IN2, and IN3 of the (j−1)th energization signal selection circuit.

The jth energization signal selection circuit selects the energization signal TP4 from the energization signals TP1 to TP8 on the basis of the 3-bit data "011", and supplies the energization signal TP4 to a corresponding head driver. The (j−1)th energization signal selection circuit selects the energization signal TP8 from the energization signals TP1 to TP8 on the basis of the 3-bit data "111",and supplies the energization signal TP8 to a corresponding head driver. As a result, an ink chamber drive waveform output from the jth head driver becomes a j pin output waveform like the one shown in FIG. 2, and an ink chamber drive waveform output from the (j−1)th head driver becomes a (j−1) pin output waveform like the one shown in FIG. 2.

In this manner, when ink is to be ejected from a given ink chamber, one is selected from the energization signals TP1 to TP8 on the basis of a 3-bit binary code of 1-bit dot data corresponding to the ink chamber and 2-bit dot data corresponding to neighboring ink chambers. A drive waveform supplied to the target ink chamber can be corrected in accordance with the degree of interference from neighboring ink chambers. Even if the target ink chamber is influenced by crosstalk from adjacent ink chambers, the ink ejection amount can be corrected with high precision to satisfactorily improve the print quality. In the driving device having the above arrangement, even if dot data of a target ink chamber is "0", TP1, TP2, TP5, and TP6 can be selected from Table 1, and thus a drive waveform can be output in accordance with an ambient drive state.

In the first embodiment, dot data of two adjacent ink chambers are referred to for a target ink chamber. If the inputs of the energization selection circuit are increased in number to refer to a larger number of ink chambers, and the numbers of combinations and energization signals are increased as needed, energization signals can be selected with reference to ink chambers in a wider range.

Figure 3:
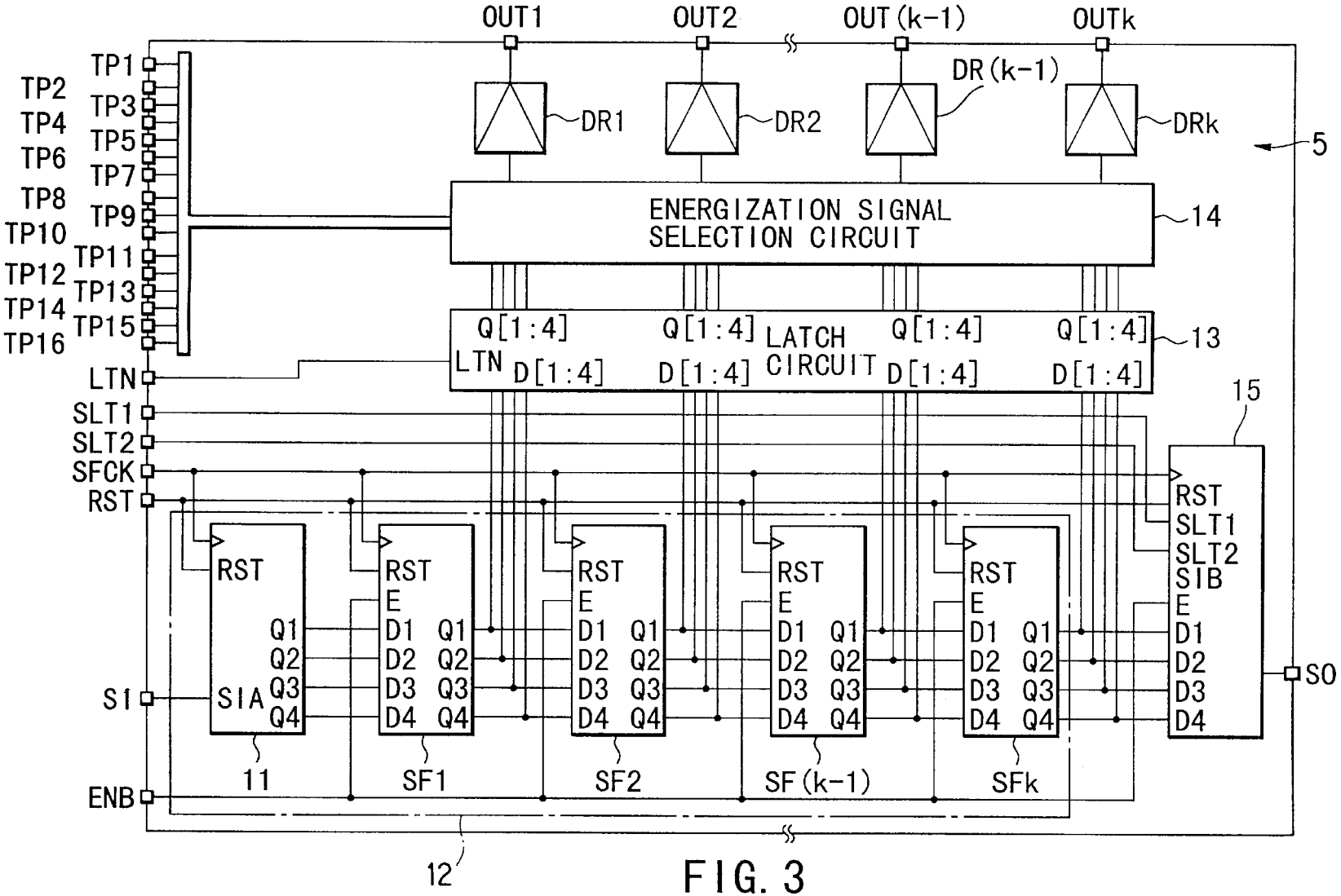
FIG. 3 is a block diagram showing the circuit of an ink-jet head driving device according to the second embodiment of the present invention.

An ink-jet head driving device according to the second embodiment of the present invention will be described with reference to FIGS. 3 to 5. The same reference numerals as in the first embodiment denote the similar components, and only the difference will be explained. In this ink-jet head driving device, as shown in FIG. 3, the reception unit 12 is constituted by k 4-bit parallel shift registers SF1, SF2 , . . . , SF(k−1), and SFk for receiving a parallel code up to n=4 bits as dot data, and a serial-to-parallel conversion circuit 11 capable of converting serial dot data SI of an m-bit ($1 \leqq m \leqq 2$) into a maximum of 4-bit parallel data every m bits. The ink-jet head driving device further comprises a serial data output circuit 15 for converting m-bit parallel dot data transferred from the final 4-bit parallel shift register SFk into serial data and outputting the serial data to an output terminal SO.

More specifically, data output terminals Q1 to Q4 of the serial-to-parallel conversion circuit 11 are connected to data input terminals D1 to D4 of the first parallel shift register SF1, the data output terminals Q1 to Q4 of each of the first to (k−1)th parallel shift registers SF1 to SF(k−1) are respectively connected to the data input terminals D1 to D4 of each of the second to kth parallel shift registers SF2 to SFk, and the data output terminals Q1 to Q4 of the final kth parallel shift register SFk are connected to the data input terminals D1 to D4 of the serial data output circuit 15. A reset signal RST and shift clock SFCK are supplied to the serial-to-parallel conversion circuit 11, parallel shift registers SF1 to SFk, and serial data output circuit 15. An enable signal ENB is supplied to the parallel shift registers SF1 to SFk and serial data output circuit 15, and effective bit select signals SLT1 and SLT2 are supplied to the serial data output circuit 15.

The data output terminals Q1 to Q4 of each of the parallel shift registers SF1 to SFk are connected to a corresponding input terminal D[1:4] of a latch circuit 13. The latch circuit 13 latches parallel data from the data output terminals Q1 to Q4 of the parallel shift registers SF1 to SFk at the input timing of a latch signal LTN. The latch circuit 13 supplies the latched parallel data to an energization signal selection circuit 14.

The energization signal selection circuit 14 selects one from energization signals TP1 to TP16 of 16 tone-levels, like the ones shown in Table 2, that are produced from an energization signal source (not shown) for each stage on the basis of each parallel data from the latch circuit 13. The energization signal selection circuit 14 supplies the selected signal to a corresponding one of head drivers DR1 to DRk on respective stages.

TABLE 2

| Input Data IN1–IN4 of Energization Selection Circuit (Hex) | Energization Signal TPn |
|---|---|
| F | TP16 |
| E | TP15 |
| D | TP14 |
| C | TP13 |
| B | TP12 |
| A | TP11 |
| 9 | TP10 |
| 8 | TP9 |
| 7 | TP8 |
| 6 | TP7 |
| 5 | TP6 |
| 4 | TP5 |
| 3 | TP4 |

TABLE 2-continued

| Input Data IN1–IN4 of Energization Selection Circuit (Hex) | Energization Signal TPn |
|---|---|
| 2 | TP3 |
| 1 | TP2 |
| 0 | TP1 |

Figure 4:
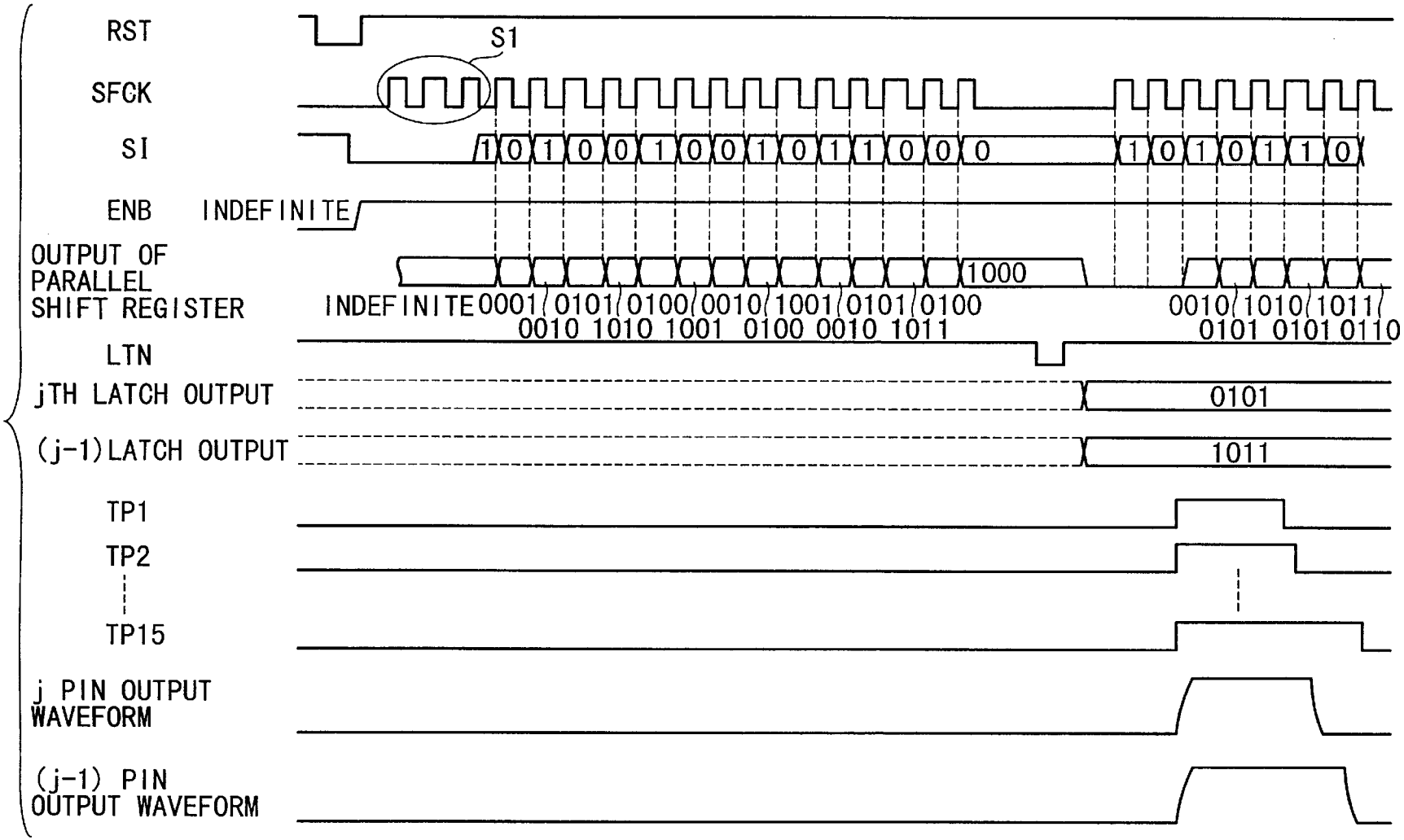
FIG. 4 is a timing chart showing an operation when 1-bit dot data is serially supplied to the ink-jet head driving device shown in FIG. 3.

In this arrangement, for example, when one dot is represented by one bit, the reset signal RST, shift clock SFCK, serial dot data SI, and enable signal ENB are input at timings shown in FIG. 4. That is, when the reset signal RST rises from low level to high level while the enable signal ENB is at high level, the serial-to-parallel conversion circuit 11, parallel shift registers SF1 to SFk, and serial data output circuit 15 are initialized. In this state, if serial dot data SI and a shift clock SFCK are input to the serial-to-parallel conversion circuit 11, the serial-to-parallel conversion circuit 11 converts the serial dot data SI into 4-bit parallel data at the timing of the shift clock SFCK. The parallel shift register s SF1 to SFk sequentially shift the converted parallel data at the timing of the shift clock SFCK.

At this time, three shift clocks indicated by S1 in FIG. 4 are input prior to the input of the serial dot data SI to obtain dummy data "000" preceding to the serial dot data SI. This allows to convert the first one bit of the serial dot data SI into 4-bit parallel data immediately when the first one bit is input. Of the 4-bit parallel data stored in each of the parallel shift registers SF1 to SFk, the least significant bit is own dot data, and the remaining upper three bits are dot data for neighboring upper levels.

After dot data for one line are stored in the parallel shift registers SF1 to SFk, the latch signal LTN is input to latch 4-bit parallel data from each of the parallel shift registers SF1 to SFk by the latch circuit 13. The 4-bit parallel data latched by the latch circuit 13 is supplied from each output terminal Q[1:4] to the energization signal selection circuit 14. The energization signal selection circuit 14 selects one from the energization signals TP1 to TP16 on the basis of the 4-bit data for each dot, and supplies the selected energization signal to a corresponding one of the head drivers DR1 to DRk.

For example, when a latch output for the jth dot is "0101" and a latch output for the (j−1)th dot is "1011", the energization signal selection circuit 14 selects the energization signal TP6 based on the data "0101" for the jth dot, and the energization signal TP12 based on the data "1011" for the (j−1)th dot. Accordingly, an ink chamber drive waveform output from the jth head driver becomes a j pin output waveform like the one shown in FIG. 4, and an ink chamber drive waveform output from the (j−1)th head driver becomes a (j−1) pin output waveform like the one shown in FIG. 4.

In this way, when one dot is represented by one bit, own dot data and 3-bit data of neighboring upper levels are referred to, and an energization signal is selected in accordance with the data contents. Also in this case, a drive waveform supplied to a target ink chamber can be corrected in accordance with the degree of interference from neighboring ink chambers. Even if the target ink chamber is influenced by crosstalk from neighboring ink chambers, the ink ejection amount can be corrected with high precision to satisfactorily improve the print quality.

Figure 5:
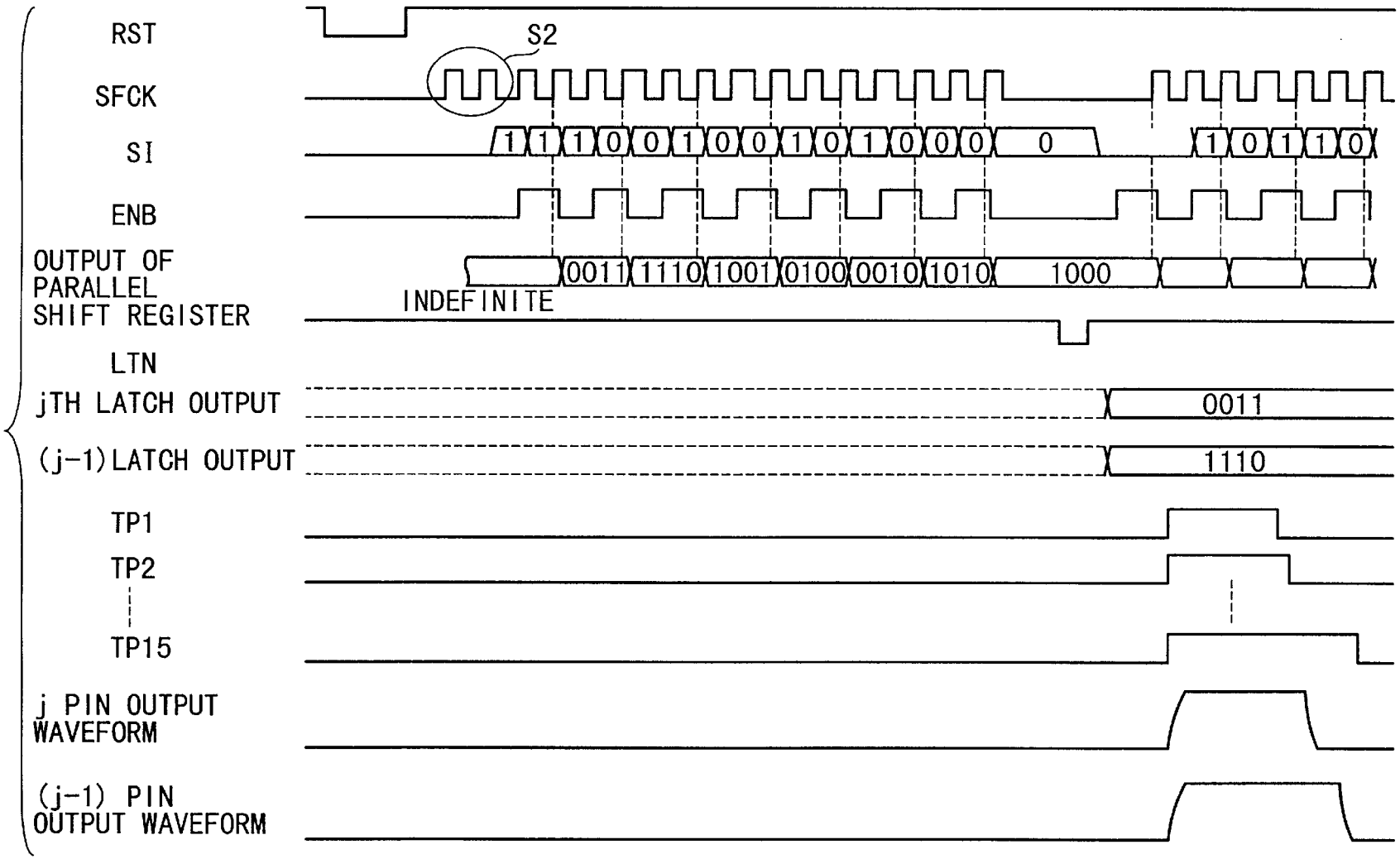
FIG. 5 is a timing chart showing an operation when 2-bit dot data is serially supplied to the ink-jet head driving device shown in FIG. 3.

When one dot is represented by two bits, the reset signal RST, shift clock SFCK, serial dot data SI, and enable signal ENB are input at timings shown in FIG. 5. That is, the enable signal ENB changes to high level every two bits. In this state, the shift clock SFCK is input to operate the serial-to-parallel conversion circuit 11 and parallel shift registers SF1 to SFk. The serial-to-parallel conversion circuit 11 converts the serial dot data SI into 4-bit parallel data at the timing of the shift clock SFCK while the enable signal ENB is at high level. The parallel shift registers SF1 to SFk sequentially shift the converted parallel data at the timing of the shift clock SFCK while the enable signal ENB is at high level.

At this time, two shift clocks indicated by S2 in FIG. 5 are input prior to the input of the serial dot data SI to obtain dummy data "00" preceding to the serial dot data SI. This allows to convert the first two bits of the serial dot data SI into 4-bit parallel data immediately when the first two bits are input. Of the 4-bit parallel data stored in each of the parallel shift registers SF1 to SFk, lower two bits are own dot data, and the remaining upper two bits are dot data of neighboring upper levels.

After dot data for one line are stored in the parallel shift registers SF1 to SFk, the latch signal LTN is input to latch 4-bit parallel data from each of the parallel shift registers SF1 to SFk by the latch circuit 13. The 4-bit parallel data latched by the latch circuit 13 is supplied from each output terminal Q[1:4] to the energization signal selection circuit 14. The energization signal selection circuit 14 selects one from the energization signals TP1 to TP16 on the basis of the 4-bit data for each dot, and supplies the selected energization signal to a corresponding one of the head drivers DR1 to DRk.

For example, when a latch output for the jth dot is "0011" and a latch output for the (j−1)th dot is "1110", the energization signal selection circuit 14 selects the energization signal TP4 based on the data "0011" for the jth dot, and the energization signal TP15 based on the data "1110" for the (j−1)th dot. Accordingly, an ink chamber drive waveform output from the jth head driver becomes a j pin output waveform like the one shown in FIG. 5, and an ink chamber drive waveform output from the (j−1)th head driver becomes a (j−1) pin output waveform like the one shown in FIG. 5.

As described above, when one dot is represented by two bits, own dot data and 2-bit data of neighboring upper levels are referred to, and an energization signal is selected in accordance with the data contents. Also in this case, a drive waveform supplied to a target ink chamber can be corrected in accordance with the degree of interference from neighboring ink chambers. Even if the target ink chamber is influenced by crosstalk from neighboring ink chambers, the ink ejection amount can be corrected with high precision to satisfactorily improve the print quality.

Note that in the second embodiment, the contents of reference neighboring data can be changed by changing the number of dummy data bits added to the serial dot data SI. For example, when one dot is represented by one bit, three dummy data bits are added. Instead, if the number of added dummy data bits is changed to two, the output Q2 of the shift register is always 1-bit own dot data, the outputs Q3 and Q4 are 2-bit data of neighboring upper levels, and the output Q1 is 1-bit data of neighboring lower level. When one dot is represented by two bits, two dummy data bits are added. If the number of added dummy data bits is changed to one, the outputs Q2 and Q3 of the shift register are always 2-bit own dot data, the output Q4 is 1-bit data of neighboring upper level, and the output Q1 is 1-bit data of neighboring lower level.

In this manner, by changing the number of added dummy data bits, reference neighboring data, i.e., reference neighboring ink chambers can be easily changed. Therefore, the reference range used to correct influence by interference from neighboring ink chambers can be changed in accordance with characteristics of ink ejected from each ink chamber of the line print head, so that the ink ejection amount can be corrected with higher precision.

The ink-jet head driving device of the second embodiment can also cope with dot data when one dot is represented by four bits. In this case, however, since all the outputs Q1 to Q4 of the shift register are own data, adjacent dot data cannot be referred to.

Figure 6:
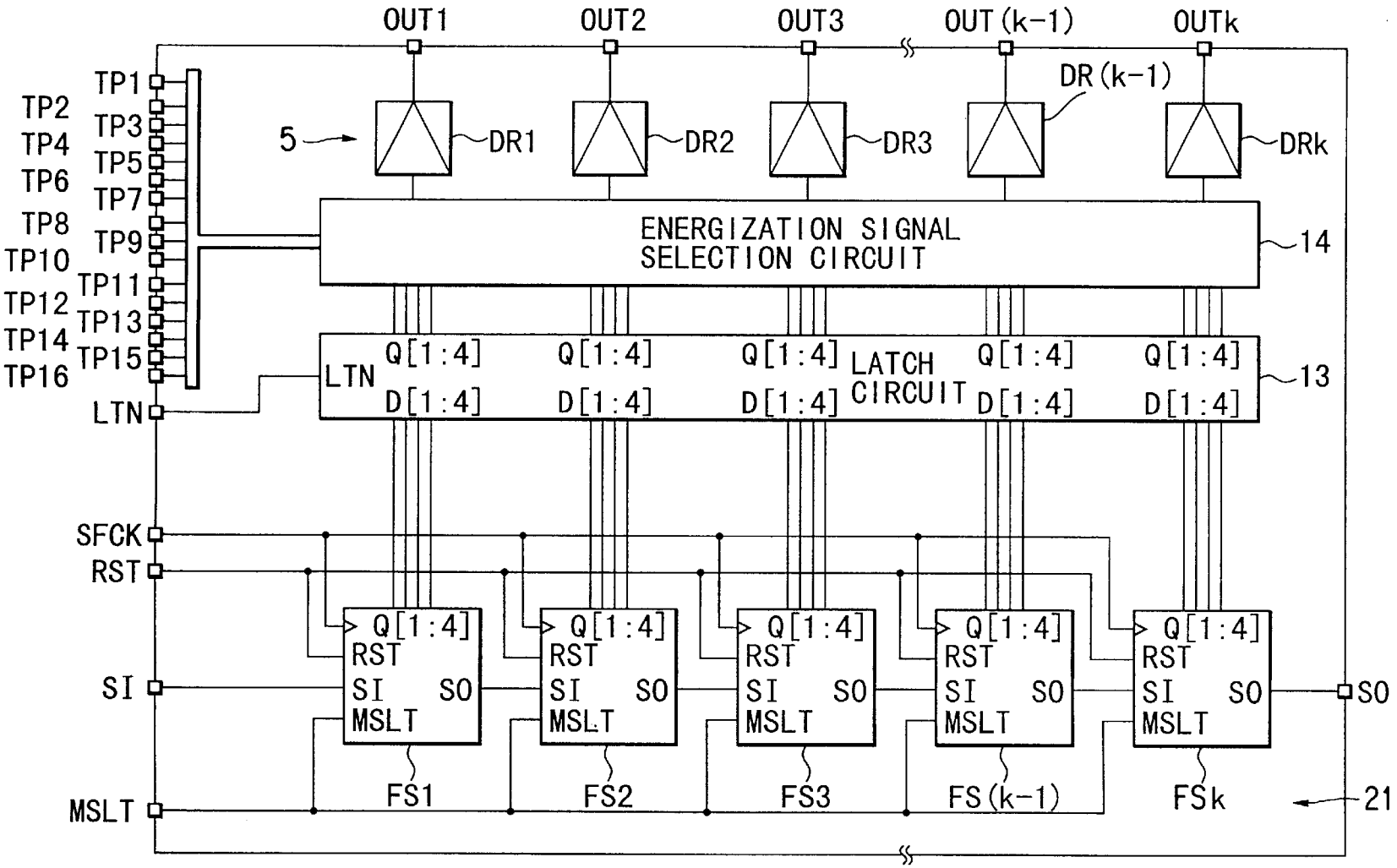
FIG. 6 is a block diagram showing the circuit of an ink-jet head driving device according to the third embodiment of the present invention.

An ink-jet head driving device according to the third embodiment of the present invention will be described with reference to accompanying drawings. The same reference numerals as in the above embodiments denote the similar components, and only the difference will be explained. In this ink-jet head driving device, as shown in FIG. 6, the reception unit 21 is constituted by k shift registers FS1, FS2, FS3, . . . , FS(k−1), and FSk with selectors. The remaining arrangement is the same as in the second embodiment.

Figure 7:
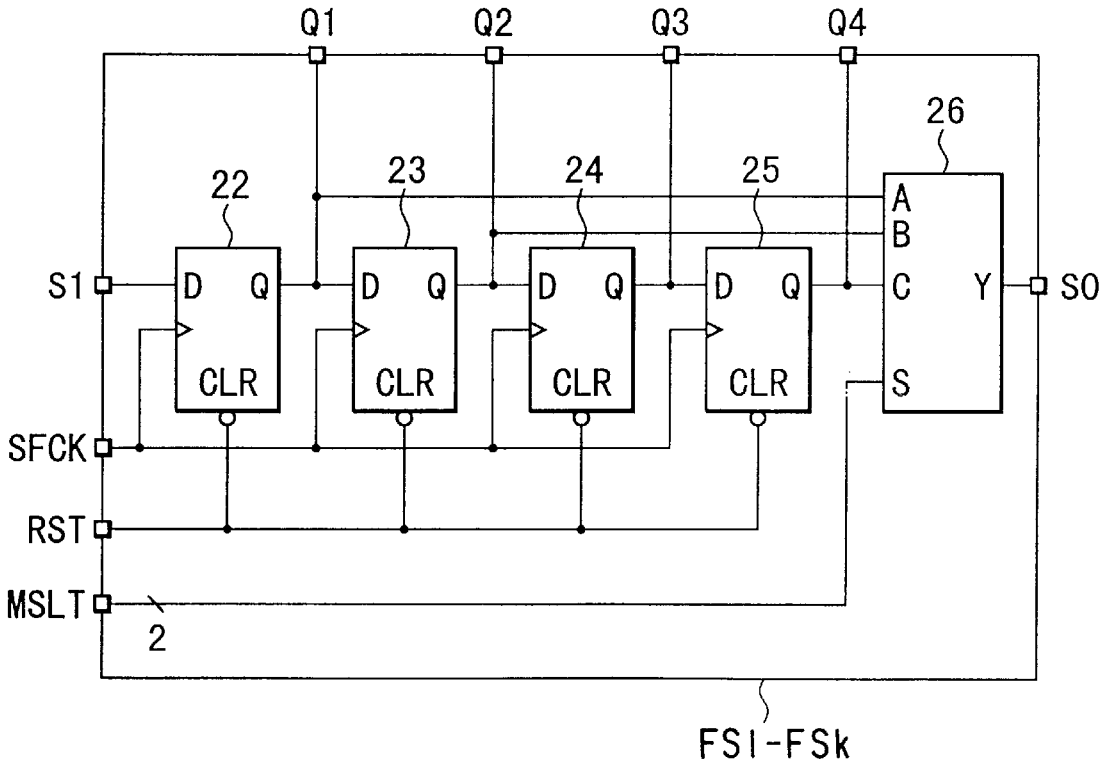
FIG. 7 is a circuit diagram showing the arrangement of a shift register with a selector shown in FIG. 6.

As shown in FIG. 7, each of the shift registers FS1 to FSk with selectors is made up of four D flip-flops 22, 23, 24, and 25 connected in series and a selector 26. Serial dot data SI is input to the input terminal D of the first flip-flop 22. Outputs from the output terminals Q of the first, second, and third flip-flops 22, 23, and 24 are respectively input to the input terminals D of the second, third, and fourth flip-flops 23, 24, and 25. An output from the output terminal Q of the final flip-flop 25 is input to the input terminal C of the selector 26.

An output from the output terminal Q of the first flip-flop 22 is input to the input terminal A of the selector 26, and an output from the output terminal Q of the second flip-flop 23 is input to the input terminal B of the selector 26. Outputs from the output terminals Q of the flip-flops 22, 23, 24, and 25 are supplied to a corresponding input terminal D[1:4] of a latch circuit 13. Each of the flip-flops 22, 23, 24, and 25 is reset by a reset signal RST.

In the selector 26, one of data input from the input terminals A to C is selected, on the basis of a 2-bit control signal MSLT (MSLT1, MSLT2), for outputting the selected data to the output terminal Y. The selector 26 selects an input from the input terminal A for MSLT1=0 and MSLT2=0, an input from the input terminal B for MSLT1=1 and MSLT2=0, and an input from the input terminal C for MSLT1=1 and MSLT2=1.

Figure 8:
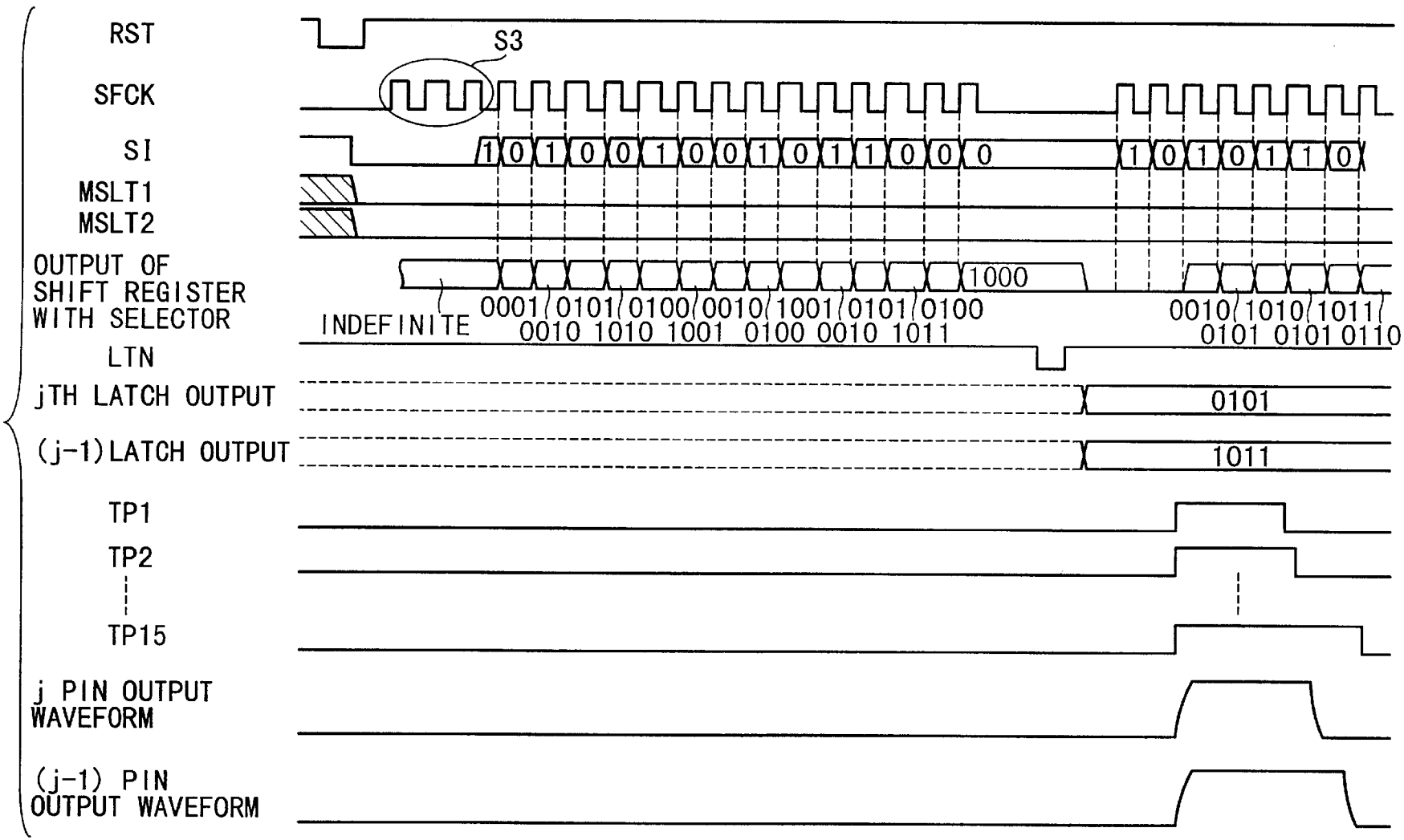
FIG. 8 is a timing chart showing an operation when 1-bit dot data is serially supplied to the ink-jet head driving device shown in FIG. 6.

In this arrangement, for example, when one dot is represented by one bit, the reset signal RST, shift clock SFCK, and serial dot data SI are input at such timings and the control signals MSLT1 and MSLT2 are at such levels as shown in FIG. 8. That is, the control signals are set to MSLT1=0 and MSLT2=0. The flip-flops 22 to 25 of each of the shift registers FS1 to FSk with selectors are reset by the reset signal RST. In this state, the serial dot data SI is sequentially shifted and stored in the shift registers FS1 to FSk by the shift clock SFCK. At this time, three shift clocks indicated by S3 in FIG. 8 are input prior to the input of the serial dot data SI to obtain dummy data "000" preceding to the serial dot data SI. This allows to form 4-bit parallel data from the first one bit of the serial dot data SI and the dummy data.

When the first one bit of the serial dot data SI is input to the first shift register FS1, and the second bit is input to the first shift register FS1 in response to the next shift clock SFCK, the first one bit is shifted from the output terminal Q of the first flip flop 22 of the first shift register FS1 to the second shift register FS2 via the selector 26. In the shift register FS1, an output from the first flip-flop 22 is shifted to the second flip-flop 23.

If, therefore, the serial dot data SI is, e.g., "10100 . . . ", the final shift register FSk outputs 4-bit parallel data Q1 to Q4 "0001", and the (k−1)th shift register FS(k−1) outputs 4-bit parallel data Q1 to Q4 "0010" upon completion of shifting of dot data for one line.

After the dot data for one line are stored in the shift registers FS1 to FSk, the latch signal LTN is input to latch 4-bit parallel data Q1 to Q4 from each of the shift registers FS1 to FSk by the latch circuit 13. Of the 4-bit parallel data Q1 to Q4, the least significant bit Q1 is own dot data, and the remaining upper three bits Q2 to Q4 are dot data of neighboring upper levels.

The 4-bit parallel data latched by the latch circuit 13 is supplied from each output terminal Q[1:4] to an energization signal selection circuit 14. The energization signal selection circuit 14 selects one from energization signals TP1 to TP16 on the basis of the 4-bit data for each dot, and supplies the selected energization signal to a corresponding one of head drivers DR1 to DRk.

For example, when a latch output for the jth dot is "0101" and a latch output for the (j−1)th dot is "1011", the energization signal selection circuit 14 selects the energization signal TP6 based on the data "0101" for the jth dot, and the energization signal TP12 based on the data "1011" for the (j−1)th dot. Then, an ink chamber drive waveform output from the jth head driver becomes a j pin output waveform like the one shown in FIG. 8, and an ink chamber drive waveform output from the (j−1)th head driver becomes a (j−1) pin output waveform like the one shown in FIG. 8.

Hence, when one dot is represented by one bit, own dot data and 3-bit data of neighboring upper levels are referred to, and an energization signal is selected in accordance with the data contents. Also in this case, a drive waveform supplied to a target ink chamber can be corrected in accordance with the degree of interference from neighboring ink chambers. Even if the target ink chamber is influenced by crosstalk from neighboring ink chambers, the ink ejection amount can be corrected with high precision to satisfactorily improve the print quality.

Figure 9:
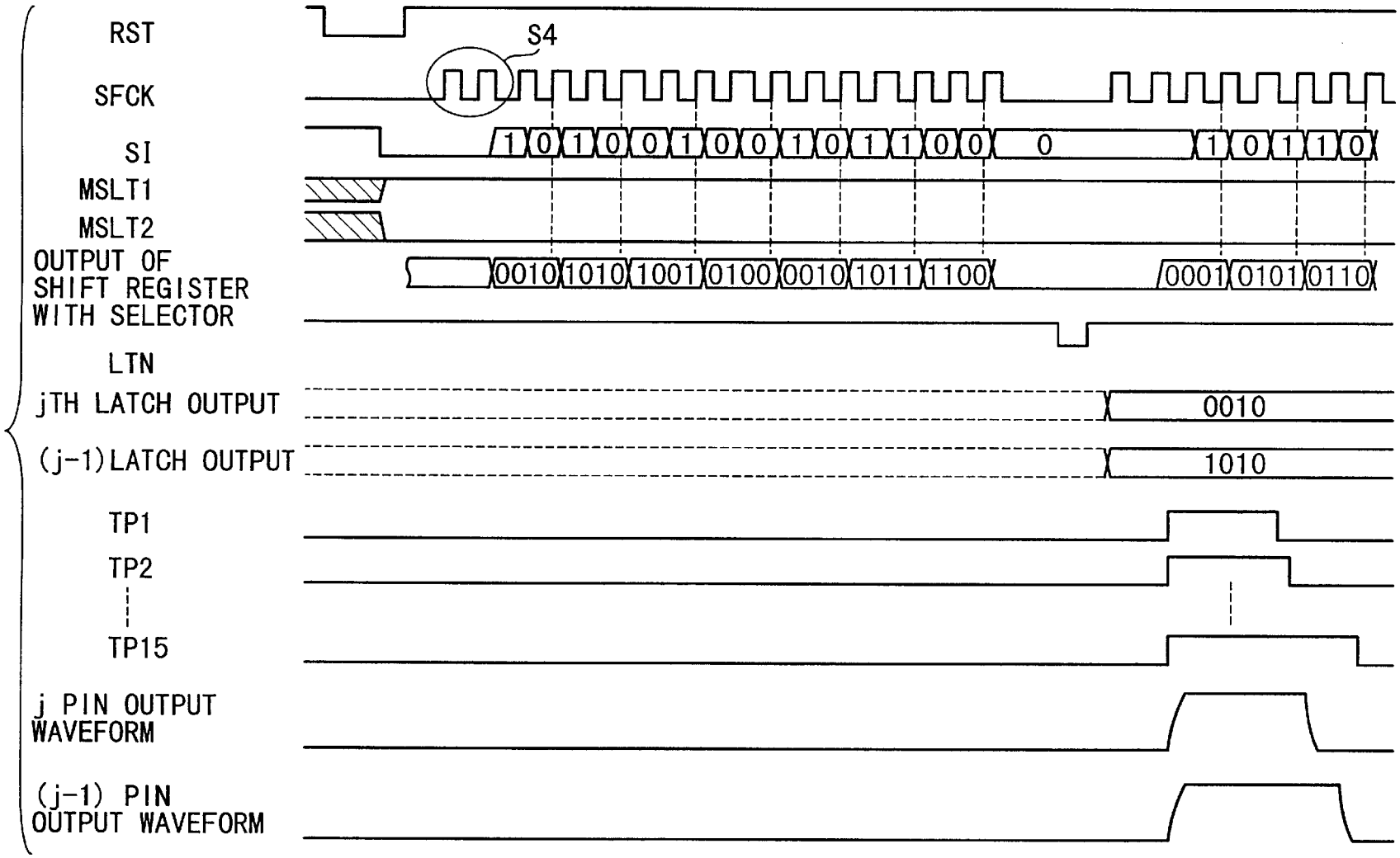
FIG. 9 is a timing chart showing an operation when 2-bit dot data is serially supplied to the ink-jet head driving device shown in FIG. 6.

When one dot is represented by two bits, the control signals are set to MSLT1=1 and MSLT2=0, as shown in FIG. 9. Two shift clocks indicated by S4 in FIG. 9 are input prior to the input of the serial dot data SI to obtain dummy data "00" preceding to the serial dot data SI. This allows to form 4-bit parallel data from the first two bits of the serial dot data SI and the dummy data.

When the first two bits of the serial dot data SI are input to the first shift register FS1, and the third bit is input to the first shift register FS1 in response to the next shift clock SFCK, the first one bit is shifted from the output terminal Q of the second flip flop 23 of the first shift register FS1 to the second shift register FS2 via the selector 26. In the shift register FS1, an output from the second flip-flop 23 is shifted to the third flip-flop 24.

If the serial dot data SI is, e.g., "10100 . . . ", the final shift register FSk outputs 4-bit parallel data Q1 to Q4 "0010", and the (k−1)th shift register FS(k−1) outputs 4-bit parallel data Q1 to Q4 "1010" upon completion of shifting of dot data for one line.

After the dot data for one line are stored in the shift registers FS1 to FSk, the latch signal LTN is input to latch 4-bit parallel data Q1 to Q4 from each of the shift registers FS1 to FSk by the latch circuit 13. Of the 4-bit parallel data Q1 to Q4, lower two bits Q1 and Q2 are own dot data, and the remaining upper two bits Q3 and Q4 are dot data of neighboring upper levels.

The 4-bit parallel data latched by the latch circuit 13 is supplied from each output terminal Q[1:4] to the energization signal selection circuit 14. The energization signal selection circuit 14 selects one from the energization signals TP1 to TP16 on the basis of the 4-bit data for each dot, and supplies the selected energization signal to a corresponding one of the head drivers DR1 to DRk.

For example, when a latch output for the jth dot is "0010" and a latch output for the (j−1)th dot is "1010", the energization signal selection circuit 14 selects the energization signal TP3 based on the data "0010" for the jth dot, and the energization signal TP11 based on the data "1010" for the (j−1)th dot. An ink chamber drive waveform output from the jth head driver becomes a j pin output waveform like the one shown in FIG. 9, and an ink chamber drive waveform output from the (j−1)th head driver becomes a (j−1) pin output waveform like the one shown in FIG. 9.

In this manner, when one dot is represented by two bits, own dot data and 2-bit data of neighboring upper levels are referred to, and an energization signal is selected in accordance with the data contents. Also in this case, a drive waveform supplied to a target ink chamber can be corrected in accordance with the degree of interference from neighboring ink chambers. Even if the target ink chamber is influenced by crosstalk from adjacent ink chambers, the ink ejection amount can be corrected with high precision to satisfactorily improve the print quality.

Note that in the third embodiment, the contents of reference neighboring data can be changed by changing the number of dummy data bits added to the serial dot data SI. For example, when one dot is represented by one bit, three dummy data bits are added. Alternatively, if the number of added dummy data bits is changed to two, the output Q2 of the shift register is always 1-bit own dot data, the outputs Q3 and Q4 are 2-bit data of neighboring upper levels, and the output Q1 is 1-bit data of neighboring lower level. When one dot is represented by two bits, two dummy data bits are added. If the number of added dummy data bits is changed to one, the outputs Q2 and Q3 of the shift register are always 2-bit own dot data, the output Q4 is 1-bit data of neighboring upper level, and the output Q1 is 1-bit data of neighboring lower level.

As described above, by changing the number of added dummy data bits, reference neighboring data, i.e., reference neighboring ink chambers can be easily changed. Therefore, the reference range used to correct influence by interference from adjacent ink chambers can be changed in accordance with characteristics of ink ejected from each ink chamber of the line print head, so that the ink ejection amount can be corrected with higher precision.

The driving device of the third embodiment can also cope with dot data when one dot is represented by four bits. In this case, however, since all the outputs Q1 to Q4 of the shift register are own data, adjacent dot data cannot be referred to.

Figure 10:
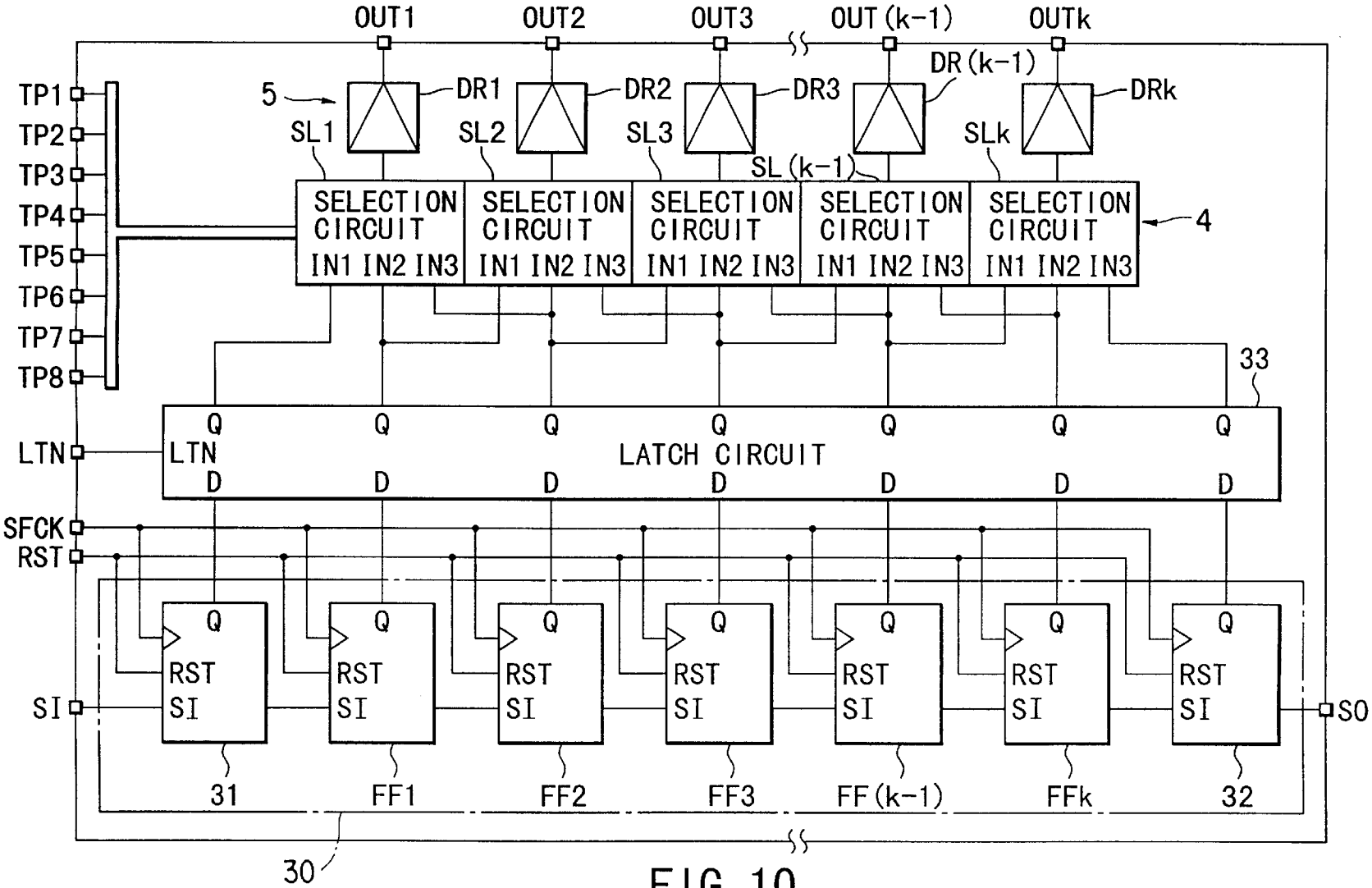
FIG. 10 is a block diagram showing the circuit of an ink-jet head driving device according to the fourth embodiment of the present invention.

An ink-jet head driving device according to the fourth embodiment of the present invention will be described with reference to accompanying drawings. The same reference numerals as in the above embodiments denote the similar components, and only the difference will be explained. In this ink-jet head driving device, as shown in FIG. 10, the reception unit 30 is constituted by adding 1-bit shift registers 31 and 32 before and after k shift registers FF1, FF2, FF3, . . . , FF(k−1), and FFk. This ink-jet head driving device further uses a latch circuit 33 in which bits for the shift registers 31 and 32 are added before and after the above-described latch circuit. The first one bit of an output from the latch circuit 33 is supplied to an input terminal IN1 of a first energization signal selection circuit SL1, and at the same time the final one bit is supplied to an input terminal IN3 of a final energization signal selection circuit SLk. The remaining arrangement is the same as in the first embodiment.

Figure 11:
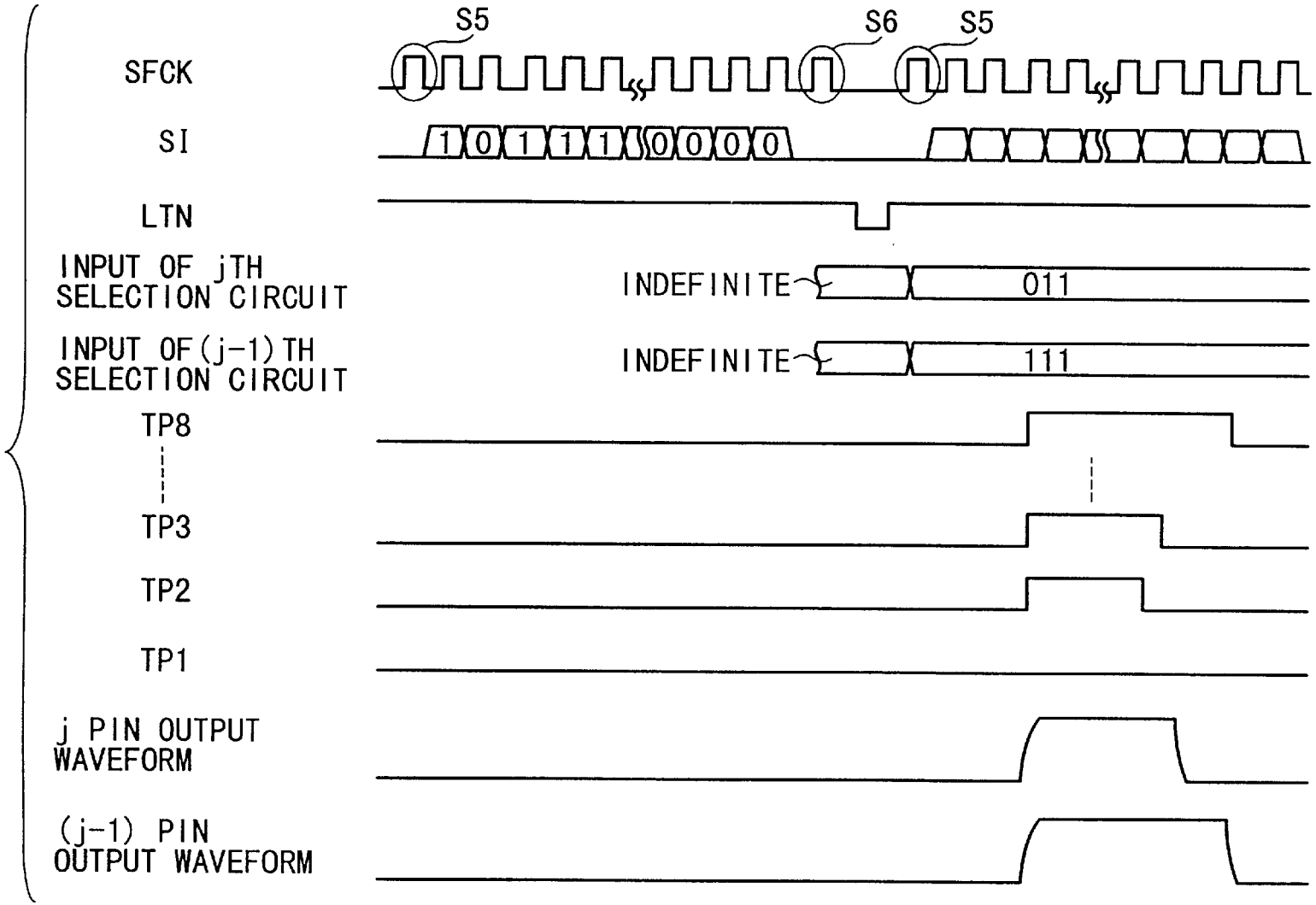
FIG. 11 is a timing chart showing an operation when 1-bit dot data i s serially supplied t o the ink-jet head driving device shown in FIG. 10 while adding dummy data before and after the dot data.

In this arrangement, for example, shift clocks S5 and S6 are respectively added before and after a shift clock SFCK for shifting one-line print data, as shown in FIG. 11. This makes the shift registers 31, FF1 to FFk, and 32 receive serial dot data SI for one line in synchronism with the shift clock SFCK while adding 1-bit dummy data "0" before and after the serial dot data SI. After the dot data for one line is received, it is latched by the latch circuit 33 in response to a latch signal LTN.

For example, when serial dot data is "10111 . . . ", data latched by the latch circuit 33 is "11010111 . . . 0" obtained by adding "0" before and after "010111 . . . 0" Accordingly, 3-bit data input from the latch circuit 33 to the input terminals IN1, IN2, and IN3 of the final energization signal selection circuit SLk is "010". Assume that 3-bit data input to the input terminals IN1, IN2, and IN3 of the jth energization signal selection circuit is "011", and 3-bit data input to the input terminals IN1, IN2, and IN3 of the (j−1)th energization signal selection circuit is "111". The jth energization signal selection circuit selects an energization signal TP4 from energization signals TP1 to TP8 based on the 3-bit data "011" and supplies the energization signal TP4 to a corresponding head driver. The (j−1)th energization signal selection circuit selects the energization signal TP8 from the energization signals TP1 to TP8 based on the 3-bit data "111" and supplies the energization signal TP8 to a corresponding head driver. Consequently, an ink chamber drive waveform output from the jth head driver becomes a j pin output waveform like the one shown in FIG. 11, and an ink chamber drive waveform output from the (j−1)th head driver becomes a (j−1) pin output waveform like the one shown in FIG. 11.

FIG. 11 shows the case in which the shift clocks S5 and S6 are respectively added before and after the shift clock SFCK for shifting dot data for one line. If the additional position of the shift clock is changed, the reference data range can be easily changed to change an energization signal to be selected.

Figure 12:
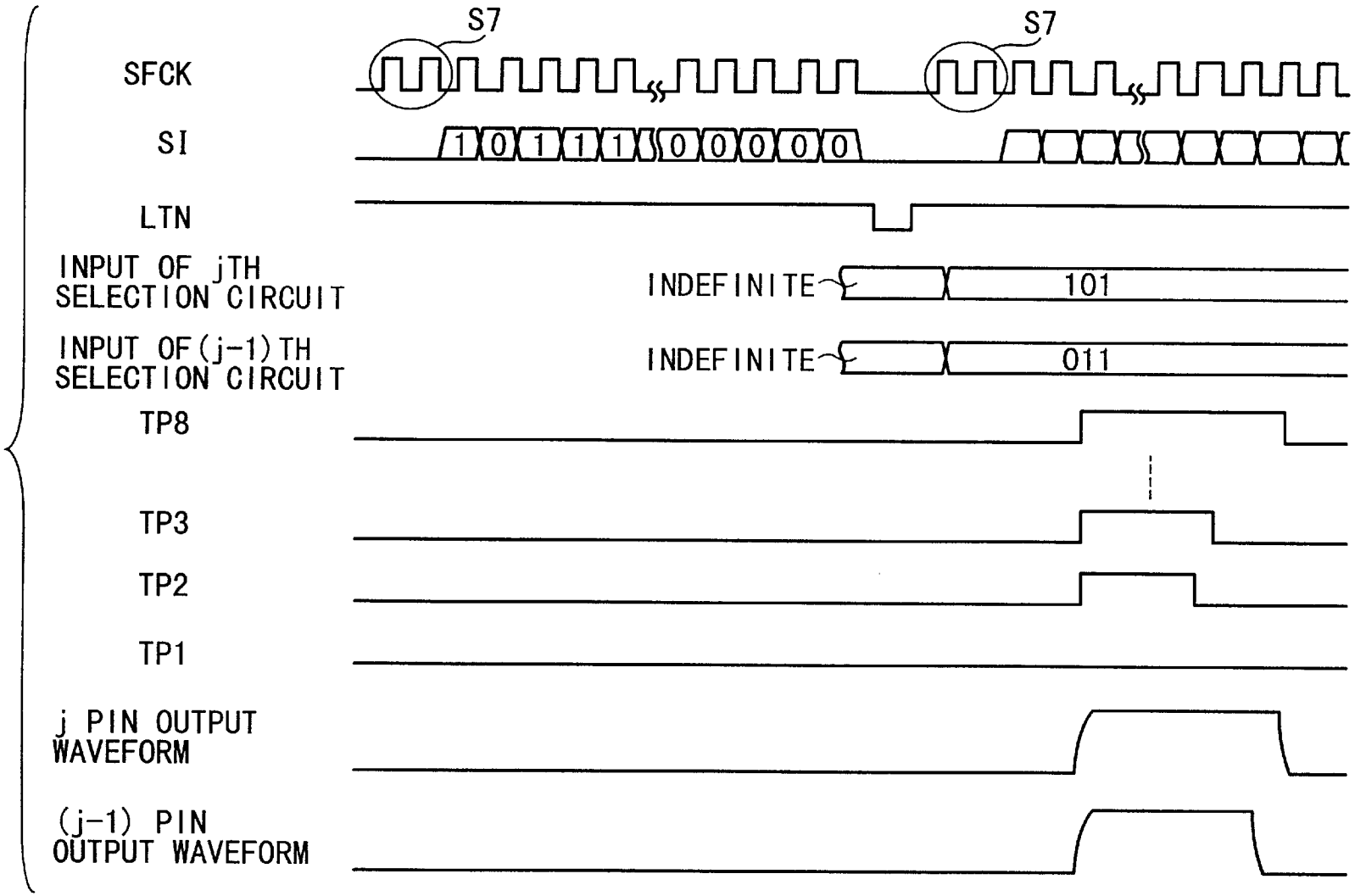
FIG. 12 is a timing chart showing an operation when 1-bit dot data is serially supplied to the ink-jet head driving device shown in FIG. 10 while adding dummy data before the dot data.

For example, two shift clocks S7 may be added before the shift clock SFCK used for one line, as shown in FIG. 12. In this case, of 3-bit data input to the input terminals IN1, IN2, and IN3 of each of the energization signal selection circuits SL1 to SLk, one bit input to the input terminal IN1 is own dot data, and two bits input to the input terminals IN2 and IN3 are reference data. In other words, two bits on the neighboring upper levels can be used as reference data. In driving, e.g., the (k−2)th ink chamber, a drive waveform can be selected in consideration of the drive states of the (k−1)th and kth ink chambers.

Then, 3-bit data input to the input terminals IN1, IN2, and IN3 of the jth energization signal selection circuit changes, e.g., from "011" to "101", and 3-bit data input to the input terminals IN1, IN2, and IN3 of the (j−1)th energization signal selection circuit changes, e.g., from "111" to "011". As a result, an energization signal to be selected changes, an ink chamber drive waveform output from the jth head driver becomes a j pin output waveform like the one shown in FIG. 12, and an ink chamber drive waveform output from the (j−1)th head driver becomes a (j−1) pin output waveform like the one shown in FIG. 12.

Figure 13:
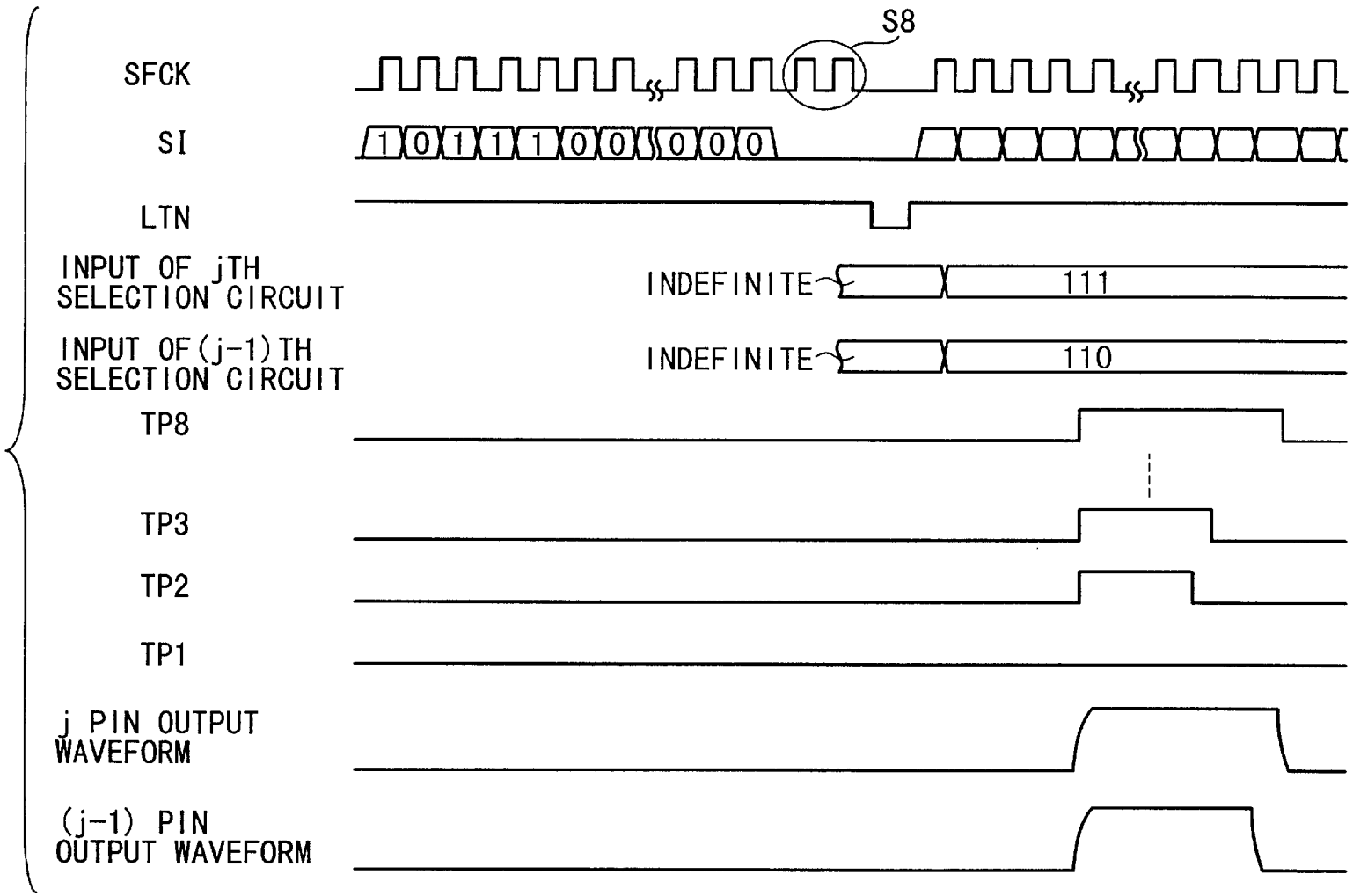
FIG. 13 is a timing chart showing an operation when 1-bit dot data is serially supplied to the ink-jet head driving device shown in FIG. 10 while adding dummy data after the dot data.

Alternatively, two shift clocks S8 may be added after the shift clock SFCK used for one line, as shown in FIG. 13. In this case, of 3-bit data input to the input terminals IN1, IN2, and IN3 of each of the energization signal selection circuits SL1 to SLk, one bit input to the input terminal IN3 is own dot data, and two bits input to the input terminals IN1 and IN2 are reference data. That is, two bits of neighboring lower levels can be used as reference data. In driving, e.g., the kth ink chamber, a drive waveform can be selected in consideration of the drive states of the (k−1)th and (k−2)th ink chambers.

Then, 3-bit data input to the input terminals IN1, IN2, and IN3 of the jth energization signal selection circuit changes, e.g., from "011" to "111",and 3-bit data input to the input terminals IN1, IN2, and IN3 of the (j−1)th energization signal selection circuit changes, e.g., from "111" to "110". As a result, an energization signal to be selected changes, an ink chamber drive waveform output from the jth head driver becomes a j pin output waveform like the one shown in FIG. 13, and an ink chamber drive waveform output from the (j−1)th head driver becomes a (j−1) pin output waveform like the one shown in FIG. 13.

As described above, when ink is to be ejected from a certain ink chamber, one is selected from the energization signals TP1 to TP8 on the basis of a 3-bit binary code of 1-bit dot data corresponding to the ink chamber and 2-bit dot data corresponding to adjacent ink chambers. A drive waveform supplied to the target ink chamber can be corrected in accordance with the degree of interference from neighboring ink chambers. Even if the target ink chamber is influenced by crosstalk from adjacent ink chambers, the ink ejection amount can be corrected with high precision to satisfactorily improve the print quality.

Moreover, reference data can be easily changed by changing the additional position of dummy data. The reference range used to correct influence by interference from adjacent ink chambers can be changed in accordance with characteristics of ink ejected from each ink chamber of the line print head, and thus the ink ejection amount can be corrected with higher precision.

In the aforementioned embodiments, the drive waveform is changed by selecting one from a plurality of energization signals set in advance by a binary code made up of own dot data and adjacent reference data. However, the present invention is not limited to this. For example, one may be selected from a plurality of energization signals based on own dot data, and the time width of the selected energization signal may be changed based on reference data, thereby changing the drive waveform.

Figure 14:
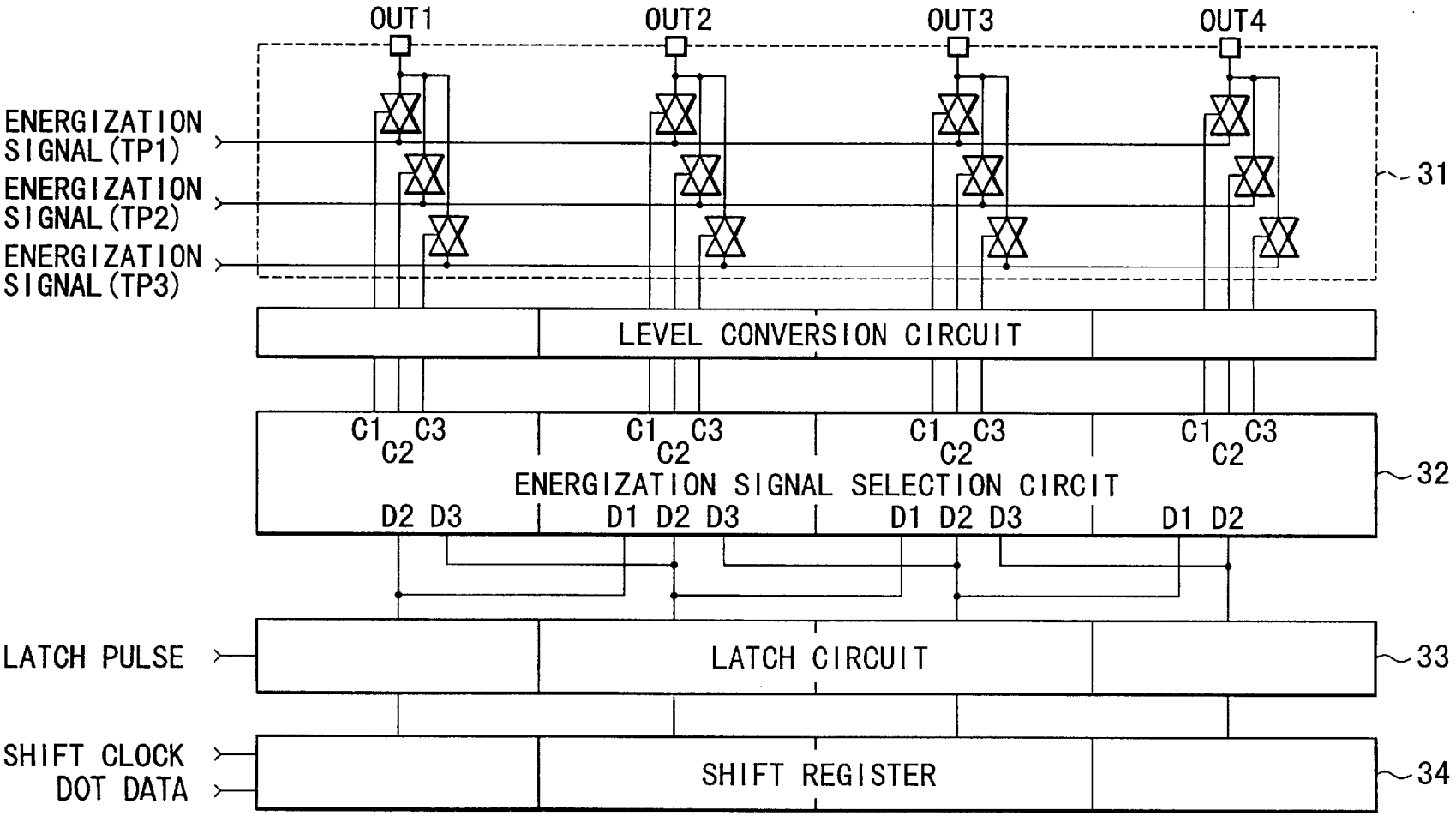
FIG. 14 is a block diagram showing the circuit of an ink-jet head driving device according to the fifth embodiment of the present invention.

FIG. 14 is a block diagram showing the circuit of an ink-jet head driving device according to the fifth embodiment of the present invention. An output switch circuit 31 comprises output terminals OUT1 to OUT4. Each output terminal is connected to three analog switches to receive energization signals TP1, TP2, and TP3 input thereto, and a control signal is input from a level conversion circuit. In dot data obtained by latching by a latch circuit 33 dot data input to a shift register 34 in synchronism with a shift clock, an energization signal selection circuit 32 receives dot data D2 for a target ink chamber and two adjacent dot data D1 and D3, and outputs an analog switch control signal so as to output any one of the energization signals TP1, TP2, and TP3 in accordance with a combination of data D1, D2, and D3, as shown in Table 3.

TABLE 3

| Input Data D1–D3 of Energization Selection Circuit | | | Energization Signal |
|---|---|---|---|
| D1 | D2 | D3 | TPn |
| 0 | 0 | 0 | TP3 |
| 0 | 0 | 1 | TP3 |
| 0 | 1 | 0 | TP1 |
| 0 | 1 | 1 | TP2 |
| 1 | 0 | 0 | TP3 |
| 1 | 0 | 1 | TP3 |
| 1 | 1 | 0 | TP2 |
| 1 | 1 | 1 | TP3 |

In Table 3, the energization signal TP1 is selected when dot data of a target ink chamber is "1" and two adjacent dot data are "0"; the energization signal TP2 is selected when dot data of a target ink chamber is "1" and either one of two adjacent dot data is "1" (OR condition); and the energization signal TP3 is selected when dot data of a target ink chamber is "0". The analog switch control signal is input to the control terminal of the analog switch via the level conversion circuit, and a selected energization signal is output as a drive waveform. Although Table 3 exemplifies the OR condition, TP2 can be easily selected when both two adjacent dot data are "1" (AND condition) within the energization signal selection circuit. As for tone data, a circuit for determining whether data is present can be employed to select an energization signal based on the flag data.

Figure 15:
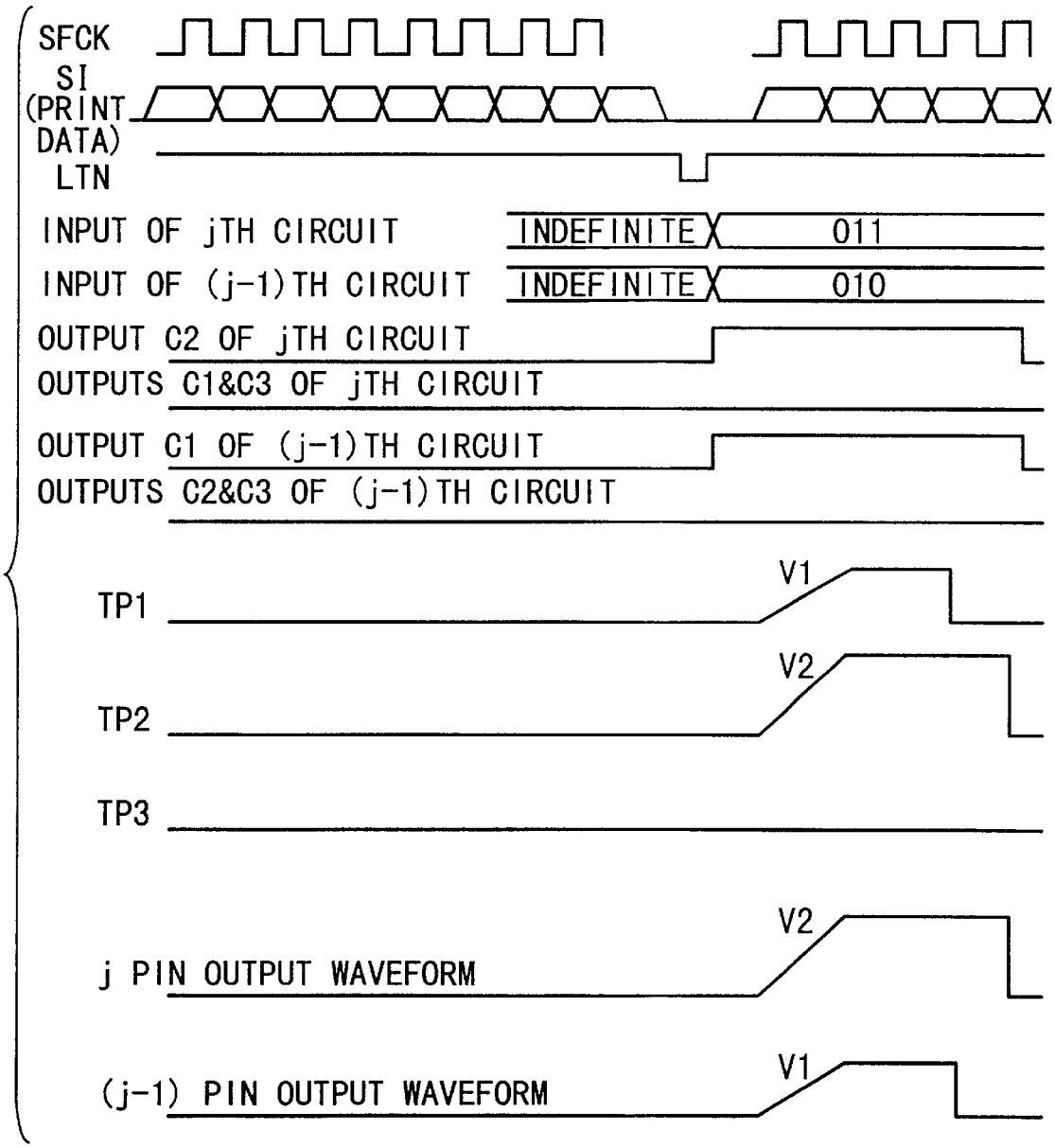
FIG. 15 is a timing chart showing an operation of the ink-jet head driving device shown in FIG. 14.

With the arrangement shown in FIG. 14, a signal supplied to the analog switch can be freely changed in addition to the energization signal change scheme (pulse width). If energization signals having different voltage values or waveforms having different waveform gradients are input, the waveforms can be selected depending on dot data (see FIG. 15). FIG. 15 shows an example. The energization signals TP1 to TP3 have different voltages, different pulse widths, and different waveform gradients, and are respectively connected to the inputs of the analog switches of the output switch circuit 31. Dot data SI is input and shifted in synchronism with a shift clock SFCK, and, upon completion of shifting, latched by the latch circuit 33 in response to a signal LTN also serving as a next print timing. Of the latched data, dot data D1, D2, and D3 of target and two adjacent ink chambers are input to the energization signal selection circuit 32. When the jth energization signal selection circuit receives "011" and the (j−1)th energization signal selection circuit receives "010", a signal for turning on the analog switch of TP2 is output from the energization signal selection circuit to the j pin output so as to output the energization signal TP2 in accordance with Table 3 (C2=H; C1, C3=L). A signal for turning on the analog switch of TP1 is output from the energization signal selection circuit to the (j−1) pin output so as to output the energization signal TP1 (C1=H; C2, C3=L). Each signal is level-converted by the level conversion circuit and input to the control terminal of the analog switch. Each output outputs a drive waveform from the selected energization signal.

The structure of an ink-jet device commonly applicable to the above embodiments will be described.

Figure 16:
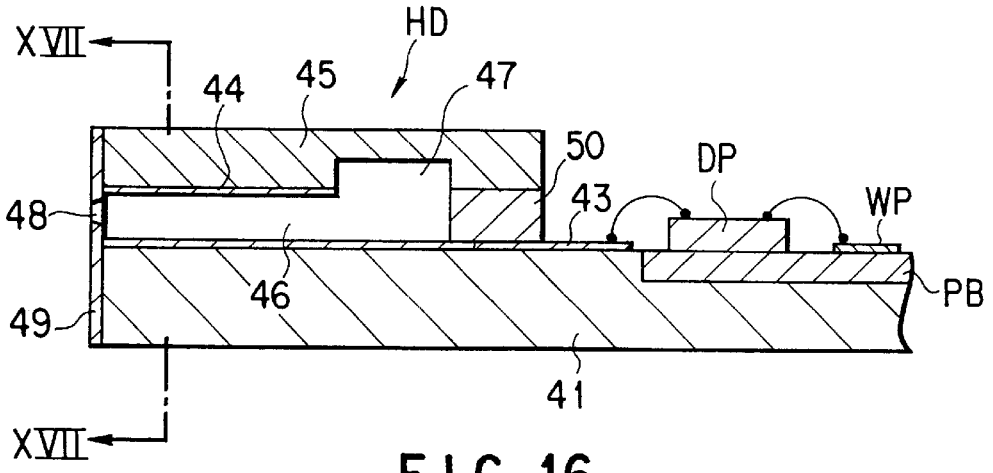
FIG. 16 is a sectional view of an ink-jet device applicable to each of the embodiments.
Figure 17:
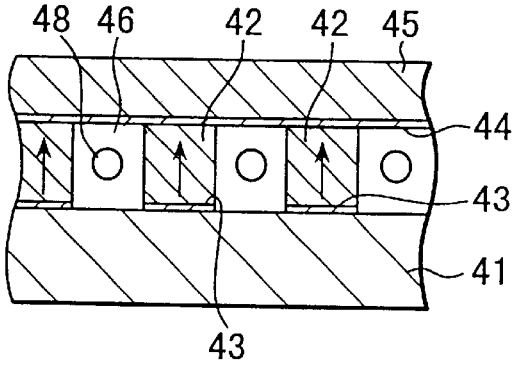
FIG. 17 is a sectional view of the ink-jet device taken along the line XVII—XVII shown in FIG. 16.

FIG. 16 is a sectional view of the ink-jet device, and FIG. 17 is a sectional view of the ink-jet device taken along the line XVII—XVII shown in FIG. 16. This ink-jet device comprises a line print head HD of a normal mode type. The line print head includes a substrate 41, a plurality of electrostrictive members which are aligned at a predetermined pitch on the substrate 41 and polarized in a direction indicated by center arrows in FIG. 17, a plurality of ink chambers 46 which are separated from each other by the electrostrictive members serving as partitions, and a top plate 45 which is formed over the electrostrictive members 42 to cover the ink chambers 46. The line print head HD further includes a plurality of individual electrodes 43 formed below the electrostrictive members 42, a common electrode 44 formed over the electrostrictive members 42, a common ink chamber 47 which is formed in a rear-end portion of the top plate 45 to supply ink to each of the ink chambers 46, and an orifice plate 49 affixed to the front end of the ink chambers 46 by adhesion. The orifice plate 49 has a plurality of ink-jet nozzles 48 formed to eject ink from the ink chambers 46. The rear end of each ink chamber 46 is sealed by sealing member 50. The substrate 41 supports a print circuit board PB disposed thereon. On the print circuit board PB, the driving device of each embodiment described above is mounted in the form of a drive circuit chip DP. The drive circuit chip DP is connected to ends of individual electrodes 43 and input terminal group WP by wire-bonding.

In the line print head HD, each electrostrictive member 42 is deformed to extend upward and downward by a predetermined voltage applied between a corresponding one of the individual electrodes 43 and the common electrode 44, so that the pressure in the ink chamber 46 changes upon a change in the volume of the ink chamber 46 to print a dot with ink ejected from the ink-jet nozzle 48. The voltage applied between the individual electrode and the common electrode 44 is determined by the drive waveform obtained from the output pins OUT1 to OUTk in each embodiment described above.

In this head, the electrostrictive member 42 constituting a partition is shared by neighboring ink chambers, and respective ink chambers 46 communicate with each other via the common ink chamber 47 for supplying ink. The ink chambers therefore influence not only adjacent ink chambers but also neighboring ink chambers. Further, neighboring ink chambers cannot be simultaneously driven. In general, ink chambers are divided into three groups each including every third ink chamber, and ink chambers of these groups are driven with timing shifts, which is called three-divisional driving. While ink chambers of a given group are driven, ink chambers of the remaining two groups are kept stopped.

In the use of this head, when ink chambers of one group are to be driven, dot data for driving the ink chambers of the group is stored in a shift register constituting a reception unit. Under the control for selecting an energization signal using dot data of two adjacent ink chambers as reference data, adjacent ink chambers in the same group, i.e., third next ink chambers each skipping two ink chambers on each side of a certain ink chamber when viewed from the entire head are regarded as adjacent ink chambers, and dot data of these ink chambers are actually used as reference data.

Under this control, even if adjacent ink chambers in the same group simultaneously operate to influence each other, an energization signal can be selected in consideration of this influence. Even if operations of ink chambers influence each other, the ink chamber can always eject a proper amount of ink drop, thereby improving the print quality.

Figure 19:
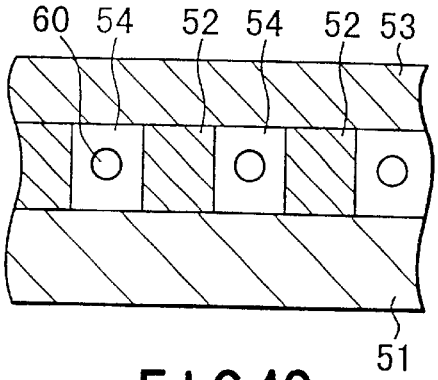
FIG. 19 is a sectional view of the modification taken along the line XIX—XIX shown in FIG. 18.
Figure 18:
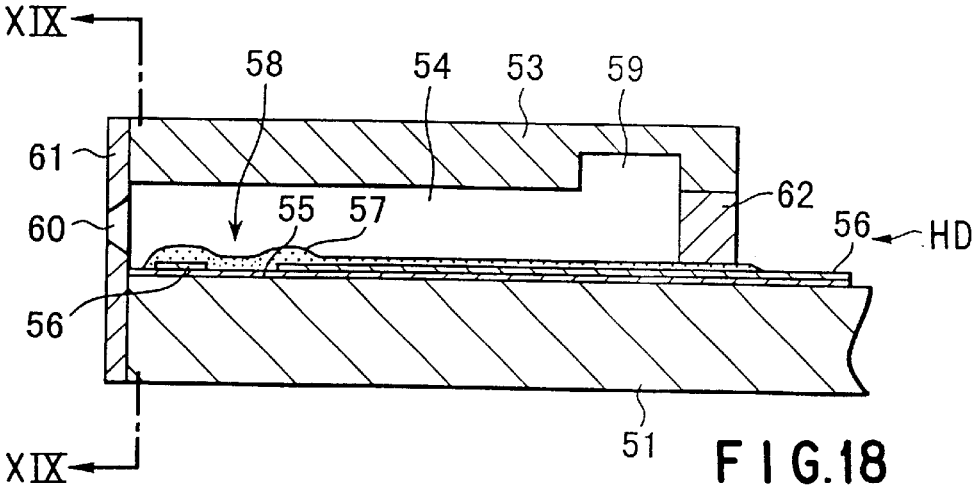
FIG. 18 is a sectional view of a modification of the line print head shown in FIG. 16.

FIGS. 18 and 19 show a bubble jet line print head usable for the ink-jet device shown in FIG. 16. In this line print head, partitions 52 are adhered onto a substrate 51 at equal intervals with a predetermined pitch, and a top plate 53 is adhered onto the partitions 52. Ink chambers 54 are formed by spaces defined by the substrate 51, partitions 52, and top plate 53. A resistor layer 55 is formed on the bottom in each ink chamber 54, an electrode layer 56 is formed on the resistor layer 55, and these layers are covered with a protective layer 57, thereby obtaining a heating element 58. A common ink chamber 59 for supplying ink to each ink chamber 54 is formed at the proximal end of the top plate 53. An orifice plate 61 having ink-jet nozzles 60 is adhered to the distal end of the ink chamber 54, and the proximal end of the ink chamber 54 is sealed by a sealing member 62.

In this head, when a predetermined drive pulse is applied to the heating element 58, ink around the heating element is abruptly heated. Then, film boiling increases the internal pressure of the ink chamber 54 to eject an ink drop from the ink-jet nozzle 60, thereby performing printing. The drive pulse applied to the heating element 58 is given by a drive waveform output from the output pins OUT1 to OUTk in the above-described embodiments.

In this head, since respective ink chambers 54 communicate with each other via the common ink chamber 59 for supplying ink, the ink chambers influence not only adjacent ink chambers but also neighboring ink chambers. In other words, pressure is transferred from a given ink chamber via the common ink chamber 59 to influence pressure variations inside another ink chamber. This head can simultaneously drive adjacent ink chambers.

In printing using this head, when a given ink chamber is driven, the degree of influence on this ink chamber changes depending on the drive states of adjacent ink chambers or neighboring ink chambers. Even if operations of ink chambers influence each other, an energization signal can be selected in consideration of this influence under the control for selecting the energization signal using dot data of neighboring ink chambers as reference data. The ink chamber can always eject an ink drop in a proper amount, thereby improving the print quality.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet head driving device for an ink-jet head having a line of ink chambers, comprising:

a reception unit which receives dot data corresponding to each ink chamber of the print head;

a decoding unit which selectively decodes (j+k)-bit data, where j is a first positive integer and k is a second positive integer, made up of received j-bit dot data of a target ink chamber and k-bit dot data of neighboring ink chambers;

an input unit which inputs a plurality of externally produced energization signals; and a selection unit which selects one energization signal from the plurality of energization signals based on a result of the decoding and drives the target ink chamber with a waveform obtained by the selected energization signal and ejects ink from the target ink chamber.

2. The ink-jet head driving device according to claim 1, wherein the k-bit dot data of the neighboring ink chamber is j-bit data representing a logical sum of two adjacent ink chambers which can be simultaneously driven.

3. The ink-jet head driving device according to claim 1, wherein the k-bit data of the neighboring ink chamber is flag data representing that data for printing is present in one of two adjacent ink chambers which can be simultaneously driven.

4. The ink-jet head driving device according to claim 1, wherein the k-bit data of the neighboring ink chamber is flag data representing that dot data for printing is present in both two adjacent ink chambers which can be simultaneously driven.

5. The ink-jet head driving device according to claim 1, wherein a neighboring ink chamber to be referred by said selection unit for each ink chamber is changeable in reception operation.

6. The ink-jet head driving device according to claim 1, wherein said reception unit is arranged to receive a maximum of n-bit dot data, where n is a third positive integer, and has a reception path change unit for changing a dot data reception path depending on the number m, where m is a fourth positive integer smaller than n, of bits when dot data of m bits is to be received, thereby causing dot data of an ink chamber and dot data of a neighboring ink chamber to be input to said reception unit for said ink chamber.

7. The ink-jet head driving device according to claim 6, wherein said reception unit includes multiple n-bit parallel shift registers which receive a maximum of n-bit parallel dot data, and said reception path change unit comprises a conversion unit which serial/parallel-converts serial dot data of m ($1 \geqq m \geqq n$) bits every m bits, and a transfer unit which transfers the parallel dot data converted by said conversion unit to said multiple n-bit parallel shift registers in units of m bits.

8. The ink-jet head driving device according to claim 7, wherein when printing of one line completes, and said multiple n-bit parallel shift registers newly receive parallel dot data for printing of a next one line, dummy data is added to the serial dot data so as not to leave previous dot data in said n-bit parallel shift registers.

9. The ink-jet head driving device according to claim 6, wherein said reception unit includes multiple n-bit shift registers which receive a maximum of n-bit serial dot data, and said reception path change unit includes a transfer unit which shifts, when the number of bits of dot data to be received is given by m ($1 \geqq m \geqq n$) bits, shifting m-bit serial dot data, then the serial dot data to an output stage within an own shift register, and transferring the serial dot data to a next shift register.

10. The ink-jet head driving device according to claim 9, wherein when printing of one line completes, and said multiple shift registers newly receive serial dot data for printing of the next one line, dummy data is added to the serial not data so as not to leave previous dot data in said shift registers.

11. The ink-jet head driving device according to claim 1, wherein said print head is constituted not to simultaneously eject ink from adjacent ink chambers, and when each ink chamber is driven by selecting one from a plurality of energization signals in a group of ink chambers which can simultaneously eject ink, refers to dot data of an ink chamber neighboring to the target ink chamber in the group.

12. An ink-jet head driving device for an ink-jet head having a line of ink chambers, comprising:

a reception unit which receives dot data corresponding to each ink chamber of the print head;

a decoding unit which selectively decodes (j+k)-bit data made up of received j-bit dot data ($j \geqq 1$) of a target ink chamber and k-bit dot data ($k \geqq 1$) of neighboring ink chambers;

an input unit which inputs a plurality of energization signals; and a selection unit for selecting one energization signal from the plurality of energization signals;

wherein the selection unit is arranged to determine an energization signal to be selected based on a decoding result of the decoding and to drive the target ink chamber with a waveform obtained by the energization signal selected thereby; and wherein when printing of one line completes, and said multiple n-bit parallel shift registers newly receive parallel dot data for printing of a next one line, dummy data is added to the serial dot data so as not to leave previous dot data in said n-bit parallel shift registers.

13. An ink-jet head driving device for an ink-jet head having a line of ink chambers, comprising:

a reception unit which receives dot data corresponding to each ink chamber of the print head;

a decoding unit which selectively decodes (j+k)-bit data made up of received j-bit dot data ($j \geqq 1$) of a target ink chamber and k-bit dot data ($k \geqq 1$) of neighboring ink chambers;

an input unit which inputs a plurality of energization signals; and a selection unit for selecting one energization signal from the plurality of energization signals;

wherein the selection unit is arranged to determine an energization signal to be selected based on a decoding result of the decoding and to drive the target ink chamber with a waveform obtained by the energization signal selected thereby;

wherein when printing of one line completes, and said multiple shift registers newly receive serial dot data for printing of the next one line, dummy data is added to the serial not data so as not to leave previous dot data in said shift registers;

wherein said reception unit includes multiple n-bit shift registers for receiving a maximum of n-bit serial dot data, and said reception path change unit includes a transfer unit for, when the number of bits of dot data to be received is given by m ($1 \geqq m \geqq n$) bits, shifting m-bit serial dot data, then shifting the serial dot data to an output stage within an own shift register, and transferring the serial dot data to a next shift register.

* * * * *